US006789291B2

(12) United States Patent
Velinsky et al.

(10) Patent No.: US 6,789,291 B2
(45) Date of Patent: Sep. 14, 2004

(54) TELEROBOTIC NOZZLE POSITIONING SYSTEM FOR AN AUTOMATED ROADWAY DEBRIS VACUUM VEHICLE

(75) Inventors: Steven A. Velinsky, Davis, CA (US); Wilderich A. White, Davis, CA (US); Andrew A. Porterfield, Benecia, CA (US)

(73) Assignee: The Regents of the University of California, Oakland, CA (US)

( * ) Notice: Subject to any disclaimer, the term of this patent is extended or adjusted under 35 U.S.C. 154(b) by 297 days.

(21) Appl. No.: 10/056,993

(22) Filed: Jan. 23, 2002

(65) Prior Publication Data

US 2002/0157212 A1 Oct. 31, 2002

Related U.S. Application Data

(60) Provisional application No. 60/286,813, filed on Apr. 25, 2001.

(51) Int. Cl.[7] ..... A47L 9/24; E01H 1/08

(52) U.S. Cl. ..... 15/414; 15/340.1; 406/39

(58) Field of Search ..... 15/315, 340.1, 15/347, 414; 406/39, 41–43

(56) References Cited

U.S. PATENT DOCUMENTS

| | | | | |
|---|---|---|---|---|
| 3,150,404 A | | 9/1964 | Johnson | |
| 3,348,258 A | * | 10/1967 | Daneman | 15/314 |
| 3,444,581 A | | 5/1969 | Daneman | |
| 3,913,307 A | | 10/1975 | Cardinal, Jr. | |
| 4,019,219 A | | 4/1977 | Willenborg | |
| 4,068,824 A | | 1/1978 | Flynn | |
| 4,207,647 A | * | 6/1980 | Masters | 15/302 |
| 4,277,214 A | | 7/1981 | Mahle et al. | |
| 4,659,262 A | | 4/1987 | van Aalst | |
| 4,661,680 A | | 4/1987 | Swensrud | |
| 4,995,138 A | * | 2/1991 | Pullen | 15/340.1 |
| 5,050,265 A | * | 9/1991 | Stout et al. | 15/340.1 |
| 5,138,742 A | | 8/1992 | Charky | |
| 5,265,132 A | | 11/1993 | Zollinger | |
| 5,983,447 A | | 11/1999 | Boomgaarden | |
| 5,996,174 A | | 12/1999 | Boomgaarden et al. | |
| 6,092,261 A | | 7/2000 | Boomgaarden | |
| 6,158,926 A | * | 12/2000 | Precetti | 406/39 |

FOREIGN PATENT DOCUMENTS

| | | |
|---|---|---|
| DE | 94 14 721 U | 10/1994 |
| DE | 295 08 588 U1 | 8/1995 |
| EP | 0 485 810 A1 | 2/1992 |

* cited by examiner

*Primary Examiner*—Terrence R. Till
(74) *Attorney, Agent, or Firm*—John P. O'Banion

(57) ABSTRACT

A telerobotic nozzle positioning system for a mobile debris vacuum vehicle or for fixed particulate vacuuming applications. The apparatus has a vacuum source coupled to an adjustable boom and nozzle assembly. The nozzle assembly is mounted to the boom with a compliant upper joint that will allow the nozzle assembly to withstand impacts with obstructions without shearing the nozzle assembly from the boom. A base with an extensible fly is pivotally coupled to the upper joint and can swing with respect to the joint upon actuation of a short stroke hydraulic cylinder. The distal end of the extendable fly has a nozzle bracket assembly with a nozzle bracket, flexible hose and nozzle tip. The nozzle bracket and nozzle tip can pivot with respect to the fly. A pair of long hydraulic cylinders allows the extension of the fly from the base as well as rotation of the nozzle bracket and tip.

63 Claims, 19 Drawing Sheets

TELEROBOTIC NOZZLE POSITIONING SYSTEM FOR AN AUTOMATED ROADWAY DEBRIS VACUUM VEHICLE

CROSS-REFERENCE TO RELATED APPLICATIONS

This application claims priority from U.S. provisional application serial No. 60/286,813 filed on Apr. 25, 2001, incorporated herein by reference.

STATEMENT REGARDING FEDERALLY SPONSORED RESEARCH OR DEVELOPMENT

This invention was made with Government support under Contract No. RTA 65A0039, awarded by the Department of Transportation. The Government has certain rights in this invention.

REFERENCE TO A COMPUTER PROGRAM APPENDIX

Not Applicable

BACKGROUND OF THE INVENTION

1. Field of the Invention

This invention pertains generally to stationary and portable vacuum devices, and more particularly to a dexterous telerobotic hose and nozzle positioning system for an automated roadway debris vacuum vehicle.

2. Description of the Background Art

Urbanization has required increasingly complex systems of motorways to accommodate the movement of automotive traffic. Motorway litter comes from many sources including careless drivers and poorly covered waste hauling vehicles with open trailers.

The presence of litter on urban and suburban roadways is not only displeasing to the eye, it can be hazardous to passing motorists as well as to the environment. Collections of roadway debris often block the flow of run-off water to storm drains thereby developing flood conditions during rainy days. Litter is also blown into wildlife reserve areas, cluttering habitats, and items such as disposed automobile oil containers can contaminate plant and animal life. Some items may even be shredded and scattered over larger areas as seasonal mowing takes place by road crews to control plant growth to minimize fire hazards.

Roadway debris, such as glass shards and steel materials, can also create hazardous conditions for motorists from tire damage or through attempts to avoid the debris. Motorway debris typically consists of cardboard, rubber, plastic, glass, aluminum, steel, soil from road sweepings, lumber, dead animals, household garbage and paper in all shapes and sizes. Litter items like paper and wood will decompose over time, however other debris may be noticeable for years. Dead animals that are found on roadways will foul the air and present unsightly views for passing motorists if not removed. Some steel items such as mufflers and hub caps may take an exceptionally long period of time decompose, while plastics and rubber may not do so at all. All of these items must be removed from the roadway and disposed of properly.

Major litter accumulation areas on roadways are those nearest to on-ramps accessing fast-food establishments, along roads that lead to waste facilities, and in public rest areas. Bushes, shrubs, trees, and guardrails often catch this litter and allow it to collect in piles. Predictably, litter concentrations tend to increase in areas with higher population densities.

The cost to local and regional governments for litter removal is substantial. States spend millions of dollars per year to remove refuse from public roadways. State transportation departments must often delay material and machinery purchases as well as personnel decisions due to the drain on public funds caused by the costs of litter removal. Moreover, roadway maintenance and resurfacing activities are often delayed for litter to be removed and require the diversion of resources and workmen.

Litter removal efforts often consist of crews of workers that enter median and right-of-way areas near roadways to manually remove litter and trash that has collected over time. Clean up crews work dangerously close to high-speed traffic and are therefore exposed to injuries from the debris this traffic generates while they manually remove small articles of trash from roadways placing one item at a time into garbage bags for subsequent collection. Such crews may also restrict the flow of freeway traffic during daytime peak traffic periods.

Street sweepers with rotating broom elements, known in the art, are designed to operate on paved surfaces, and can pick up dirt, mud, leaves, paper, light cans and bottles. Sweepers can drive to a worksite and begin operation without on-site manual set-up. Many of these sweepers carry water, which is sprayed to control the dust produced by their rotating gutter and pick-up brooms. However, uneven road surfaces may permit gaps to form between either the vacuum plenum or pick-up broom and the roadway, decreasing the vehicle's cleaning effectiveness and leaving behind some litter items. Street sweepers cannot generally operate in unpaved shoulder areas without picking up significant amounts of dirt or vegetation. Doing so will unnecessarily and prematurely fill the vehicle's storage bin and create undesirable dust clouds.

Small capacity mobile vacuum devices were later developed that utilize a flexible hose that can pick up papers, leaves and other light weight refuse. However, the small overall size of these machines and their low top speed do not provide adequate operator protection from high-speed automobile traffic. Furthermore, the limited litter storage capacity requires multiple trips away from the worksite to empty the storage bin. Additionally, litter items such as cans, bottles, and rubber tire segments often cause damage to the impeller and drive motors in these small capacity machines due to jamming and clogging. Accordingly, such machines are unacceptable for use in freeway medians and shoulders.

There are also several large, high power suction vehicles designed for gutter, sewer, and culvert cleaning known in the art. These machines generally have large waste storage bins and substantial suction power, along with the capacity to carry and pump water to break up clogs in culverts and sewers. Such machines can develop enough suction to easily remove sludge, rocks, and sections of broken pavement from otherwise difficult to access depths. However, these machines typically require on-site manual set-up and use, where the operator must position the vehicle close to the intended worksite. The operator must stand outside the vehicle to manipulate the water and suction hoses for proper use, adjusting the boom angle and height hydraulically with controls on the vehicle, and then fine-tune the placement of the nozzle head through hands-on manipulation. The vehicle is normally stationary while the suction or water-pumping operations are taking place.

However, the weight of the fully equipped high capacity machines may prove prohibitive for shoulder and median litter removal operations. Accuracy in placement of the vacuum tube nozzle is not possible with this design due to the lack of active motion controls for the nozzle where it hangs below the end of the boom.

Accordingly, a need exists for an dexterous cleaning apparatus that can pick up all lightweight and most awkwardly sized trash both on and off the roadway and that will allow for spot clean up in locations under and behind guardrails, amongst most highway vegetation, and on some sloping hillsides, and that does not require on-site manual set up allowing the vehicle's operator to remain in the cab at all times. The present invention satisfies these needs, as well as others, and generally overcomes the deficiencies found in existing equipment.

BRIEF SUMMARY OF THE INVENTION

The present invention pertains to a dexterous positioning nozzle assembly that may be mounted to a litter removal vehicle or to a stationary boom. The nozzle assembly of the present invention may be added to an existing vacuum source or may be provided as original equipment.

A litter removal vehicle employing the present invention, for example, is capable of removing the majority of roadway litter in a partially automated vacuum process in areas along the roadway that are not accessible by sweepers or similar machines. The apparatus permits the collection of trash along fences, shrubbery, guardrails, medians, and some embankments by using a large vacuum nozzle that can be extended with a boom reaching forward of the vehicle's cab and swinging to the left and right sides, although other boom configurations can employ the invention as well. Under normal circumstances, the operator may remain within the safety of the vehicle's cab while performing litter abatement operations. Toggle switches and a joystick controller permit no vacuum hose positioning, vacuum fan operation, and all on-site set-up operations without the need to place an operator near dangerous high-speed traffic.

By way of example, and not of limitation, the preferred embodiment of the invention is employed with a base vehicle that is capable of transporting the debris collection system from location to location. The debris collection system includes a vacuum generating assembly and housing that draws large volumes of air and litter through the end of an intake dexterous nozzle assembly and a boom assembly to a collection bin. The control assembly for positioning the nozzle and boom assemblies is preferably placed in the cab of the vehicle to allow a single operator to position the intake nozzle over debris for collection and to control air flow.

The dexterous nozzle assembly of the present invention generally comprises an upper joint coupled to the boom, a base member, an extensible fly, short and long stroke actuators, and a nozzle bracket assembly. The long and short stroke actuators are preferably electrical, hydraulic or pneumatic systems controlled by a three-axis joystick and switches known in the art.

The upper joint is the interface point between the body of the dexterous nozzle assembly and the end of the overhead boom of the base vehicle. The upper joint may be attached to the lip that is typically at the end of the boom and provides mounts for the remaining base, fly and nozzle bracket assembly components as well as the three actuating cylinders. The upper joint consists of upper and lower trays, the union of which preferably provides a degree of compliance for the nozzle assembly. A top flexible vacuum hose within the upper joint connects the boom openings to the top of the base.

The base is a long cylindrical structure that supports cantilever moments as the fly is extended, and is an integral part of the vacuum air pathway. The base is the uppermost element of the nozzle assembly that is made to sweep back and forth during device operation by the short stroke cylinder attached to the upper joint and the base.

The fly is preferably a large diameter steel tube, capable of extending from and retracting into the base allowing the nozzle assembly to change the ground clearance of the nozzle tip. The nozzle bracket and nozzle tip hang from the fly. The extension and retraction of the fly is controlled by the simultaneous extension of the twin long-stroke cylinders mounted to the upper joint on one end and the fly and nozzle bracket assembly on the other.

The nozzle bracket and nozzle tip extend the reach of the overall nozzle assembly and increase the device's accessibility to litter on the roadway. The nozzle bracket assembly can be rotated about the end of the fly through the opposed motion of the twin long-stroke cylinders. A lower flexible vacuum hose connects the bottom of the fly to the top of the nozzle tip. The nozzle tip is the lowest element on the end-effecter, and the first element to come in contact with roadway debris. The vacuum air pathway preferably reaches from the nozzle tip and nozzle bracket assembly through the length of the fly and base to the boom and into the refuse storage bin.

An object of the invention is to provide a nozzle positioning system that can readily adapt to changes in roadway height at culverts and reach over and under obstructions such as guardrails and thereby efficiently clear debris without requiring the operator to exit the vehicle.

Another object of the invention is to provide a mobile refuse collection system that does not require any nozzle set up prior to the start of refuse collection.

Another object of the invention is to provide a device that is simple in design and has a low machine weight to allow maintenance crews the freedom to drive on unpaved shoulder and right-of-way sections of state freeways and highways and efficiently collect debris.

Another object of the invention is to provide a dexterous nozzle assembly that has a compliant joint with the boom that can withstand impacts of the end of the assembly with obstructions without shearing the nozzle assembly from the boom.

Still another object of the invention is to provide a nozzle assembly that can be easily adapted to existing intake conduits of existing vacuum sources whether on a vehicle or on a stationary applications.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings that are for illustrative purposes only.

DETAILED DESCRIPTION OF THE INVENTION

Referring more specifically to the drawings, for illustrative purposes the present invention is embodied in the apparatus generally shown in FIG. 1 through FIG. 16, where like reference numbers denote like parts. It will be appreciated that the apparatus may vary as to configuration and as to details of the parts without departing from the basic inventive concepts disclosed herein.

Figure 1:
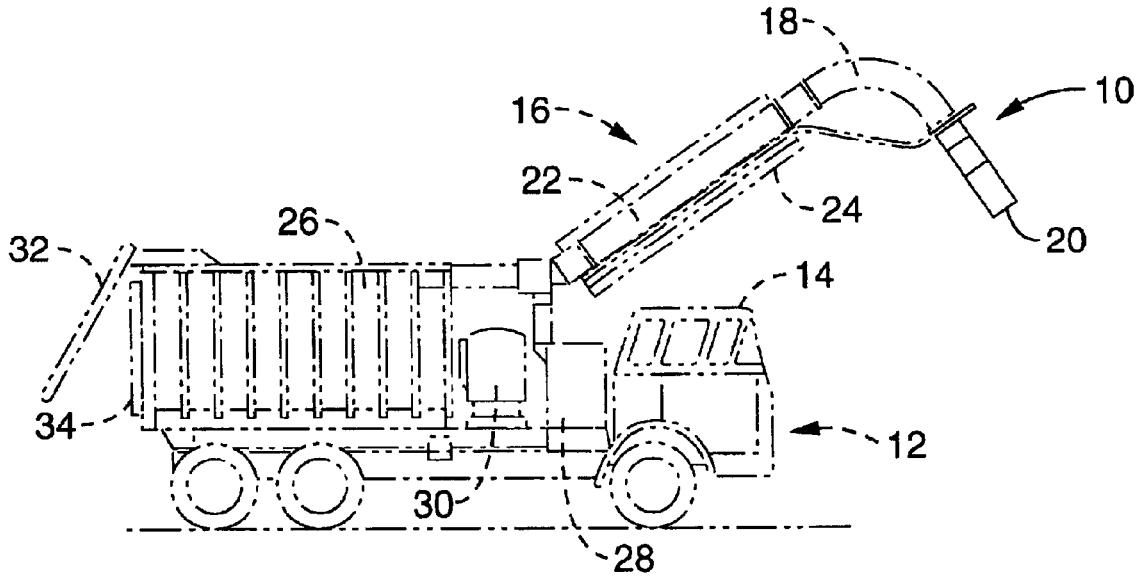
FIG. 1 is a side view of a vehicle embodiment with a maneuverable boom and nozzle assembly according to the present invention.

Referring first to FIG. 1, one embodiment of the invention utilizing a base vehicle 12 with the debris vacuum system is generally shown including a dexterous nozzle positioning assembly 10, moveable boom, and vacuum system. While the mobile embodiment of the invention is disclosed, it will be understood that the dexterous nozzle assembly of the present invention can be adapted to any stationary or mobile system that requires an intake or output manipulation.

In the embodiment shown, the nozzle positioning system may be mounted on a new standard cab and chassis vehicle or may be added onto existing equipment such as a Leach Vac/AII in order to minimize equipment costs. A gross vehicle weight rating of approximately 26,000 pounds or less, capable of carrying an additional 2,000 pounds minimum of litter weight, in addition to all added equipment and an operator, is preferred. While a gross weight of 26,000 pounds or less is preferred, it will be seen that the invention can be adapted for use on conventional boom and vacuum trucks that have gross weights of 60,000 pounds or more.

Minimizing the net weight of vehicle 12 will permit operation on unpaved shoulders and many median roadway dividers. Vehicles where the cab 14 lies atop the front axle of the vehicle are preferred because such vehicles offer the operator greater visibility of the workspace ahead of the vehicle. In addition, cab-over type vehicles will allow boom positioning without requiring the operator to lean out of his or her seat in order to visualize placement of the vacuum nozzle assembly 10. Optionally, the base vehicle 12 may have dual steering, throttle, and brake controls that permit simplified left and right side operations and increase the visible workspace to the operator.

The base vehicle 12 preferably has a linear boom assembly 16 that is capable of side-to-side, up and down and extensible motion. The available workspace of the invention may be partially defined by the motion capabilities of the boom 16 and the dexterous nozzle assembly 10. The boom assembly 16 is typically located over the cab 14 and should preferably be free to rotate +/−45° about a vertical axis from the forward orientation. The boom 16 is preferably capable of conveniently carrying large diameter tubing or flexible hose 18 and the dexterous nozzle assembly 10 weighing on the order of three hundred pounds. Points of rotation and all geometries of the boom assembly 16 should not permit kinking or binding of the hose 18 that might distort its internal airflow. In this embodiment, the boom assembly 16 should reach a minimum of 8 feet to either side of the vehicle without aid of the nozzle assembly 10.

In the embodiment shown, the nozzle assembly 10 is capable of lateral sweeping motion that is independent of the overhead boom 16. However, it is preferred that all sweeping motion of the debris removal system occurs when the nozzle assembly 10 is oriented to sweep a path perpendicular to the sides of the base vehicle 12. The boom assembly 16 and nozzle assembly 10 combined are preferably capable of raising and lowering the vacuum intake 20 of nozzle assembly 10 a total of at least 48 inches to account for changes in roadway height and embankment slopes. This preferred capability will permit placement of the vacuum nozzle assembly 10 partially underneath or behind guardrails. While a maneuverable boom 16 is preferred, it will be understood that the nozzle assembly 10 may be used successfully on a stationary boom. While stowed for roadway travel, the positioning system should not protrude beyond the width of the vehicle.

The nozzle positioning assembly 10 and boom assembly 16 should be sufficiently robust to handle dragging the vacuum nozzle 10 alongside the base vehicle 12 in cases where action of the vacuum draws the end of nozzle intake 20 towards a fixed object or the ground. Built-in compliance in the nozzle assembly 10, described in detail below, should allow minor collisions between the assembly and fixed objects without shearing the nozzle assembly 10 from boom 16.

Finally, it is preferred that all positioning system controls should be located inside the cab 14, be simple to operate, and be directly related to the motion capabilities of the boom 16 and nozzle assembly 10 so there is no need for on-site set-up that requires an operator to leave the safety of the cab 14.

In the embodiment shown, boom assembly 16 includes sections of flexible tubing 18 with sections of rigid tubing 22 on either side of the flexible tubing 18. The sections of tubing are preferably connected to boom support armature 24. The sections of tubing 18 and 22 provide the airflow to route all captured trash into an internal debris storage bin 26 located on base vehicle 12. In the embodiment shown, the flexible tubing 18 and rigid tubing 22 are preferably approximately 12 inches in diameter in order to pass the majority of roadway litter to the storage bin 26. The hose 18 and tubing 22 of boom 16 are preferably made of material that is sturdy and resistant to internal abrasion from glass, wood, small metal objects, and sand, but is smooth enough to not restrict the maximum operational airflow or promote clogging. Additionally, it is preferred that both the flexible hose 18 and rigid tubing 22 be capable of withstanding temperatures from approximately 10° C. to 49° C. (50° F. to 120° F.), and should be resistant to ultraviolet light damage and water damage. The hose 18 and tubing 22 of the boom assembly 16 are preferably connected to a centrifugal fan type vacuum pump or compressor 28 that is capable of developing a high airflow and low vacuum. A centrifugal type compressor is preferred since it is better suited to develop a high airflow and is lighter weight and requires less power than positive displacement pumps known in the art.

A vacuum pump 28 that is capable of drawing air through a 12 inch diameter hose 22 at approximately 200 mph and 6.8 kPa (2 inches Hg) or greater is preferred in order to draw in typical roadway litter but not necessarily rocks or rooted vegetation. Airflow should be maintained independent of the volume of litter in the debris storage bin 26.

The vacuum fan (not shown), which draws air into the storage bin 26 at high speeds, may be driven in one of several ways known in the art depending on the fan horsepower requirements and vehicle 12 space limitations. For example, a belt and pulley or gear transmission may be necessary to transmit power to the vacuum fan, or it may be directly attached to a chassis mounted, auxiliary internal combustion engine 30 as in the embodiment shown. Alternatively, a hydraulic motor may drive the fan.

It may be necessary to control the speed of the vacuum fan to adjust the airflow rate through nozzle assembly 10 and boom assembly 16, or to have the capability of slowing the rotational speed of the fan during system shut down. It is preferred that the controls to the vacuum motor/fan 28 as well as any auxiliary engine 30 controls be routed to the cab 14 of the base vehicle 12.

The vacuum fan and housing are preferably connected to a debris storage bin 26 that has a preferred minimum of 5 cubic yards of storage capacity. The ability to tilt the storage bin 26 and unload its contents is also preferred. In one embodiment, a lockable flap or full-sized door 32 is provided at the distal end 34 of debris bin 26 to permit easy unloading of collected refuse. The controls for tilting bin 26 and door 32 operations are preferably hydraulically actuated via controls in the cab 14 or on the base vehicle body 12.

In another embodiment, a method for compacting the collected debris is provided in order to increase the collectable volume of trash in bin 26. Such compacting capabilities may include physically pressing the litter into a smaller volume with augers or pistons or the like. Alternatively, the motion of the vacuum air may be used to draw the collected trash items towards the base or rear of bin 26.

No litter should pass through the fan system after being drawn into the debris storage bin 26. In one embodiment, a filtering mechanism (not shown) is provided that will prevent all litter and the majority of dust and small particles from entering the fan system and passing on to the environment. For example, airflow filtering may be accomplished within the debris storage bin 26 with metal screens and a dust settling box known in the art. Filtering mechanisms known in the art will prolong the life of the components of the fan system and avoid returning any items removed from the roadway to the surroundings.

In another embodiment, an exhaust muffler (not shown) is set to vent discharge air vertically to the atmosphere to control noise generated by the exhaust airflow. An enclosure for the fan power source may be necessary to attenuate noise generated by an auxiliary engine. Dust and particulate emissions from the vacuum system's exhaust should be kept to a minimum. The vacuum fan may be fully enclosed with inlet and outlet ducting spaced to permit connections to the storage bin, filtering, and muffler systems.

Control of the vacuum compressor 28, boom assembly 16, nozzle assembly 10 and other components of the system is preferably provided through electrical and hydraulic systems operable by a single operator in cab 14 of vehicle 12. In the preferred embodiment, a multiple function joystick is ideal for controlling the motion of boom assembly 16 and nozzle assembly 10 due to the ease of operation. In one embodiment an analog joystick is used and an analog-to-digital converter or computer to manipulate control signals to the proportional hydraulic valves that actuate the nozzle placement system.

It is preferred that the base vehicle 12 operate on a standard 12-volt direct current electrical system. All added electrical components such as hydraulic valves, joystick controller, and indicator lights and the like should be capable of operation in a similar 12-volt system. The electrical system should not be capable of damaging the vehicle's electronics or hindering the vehicle's roadworthiness. Accordingly, adequate fuse protection and safety shutdown components are preferably installed, and all wires and major termination panels are preferably clearly labeled to aid in equipment maintenance.

The preferred hydraulic system may be powered by the vehicle's 12 engine or the auxiliary engine 30 mounted to the chassis. In either case, the vehicle 12 should be drivable while the hydraulic pump develops adequate power for all hydraulic components. Proportional valves may be required to permit fine placement control of all nozzle positioning system components.

The characteristics of a base vehicle 12 discussed above are preferences provided as an example of a base vehicle, not as limitations, and it will be understood that the nozzle assembly 10 of the present invention may be adapted for installation on new or existing vehicles that are configured differently or the assembly adapted for another purpose without departing from the scope of the invention.

Figure 2:
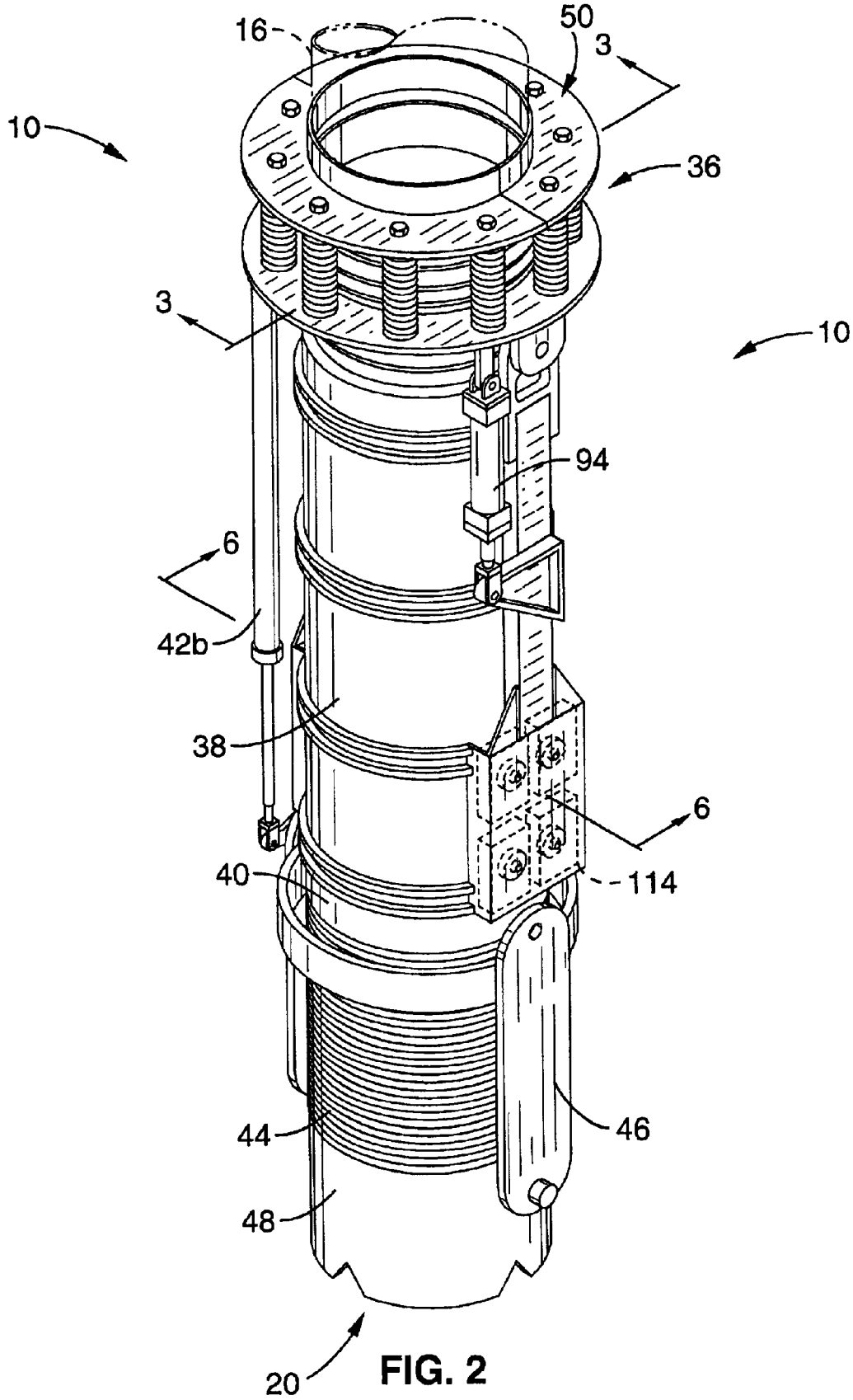
FIG. 2 is a side view in perspective of an embodiment of the nozzle assembly according to the present invention.
Figure 14:
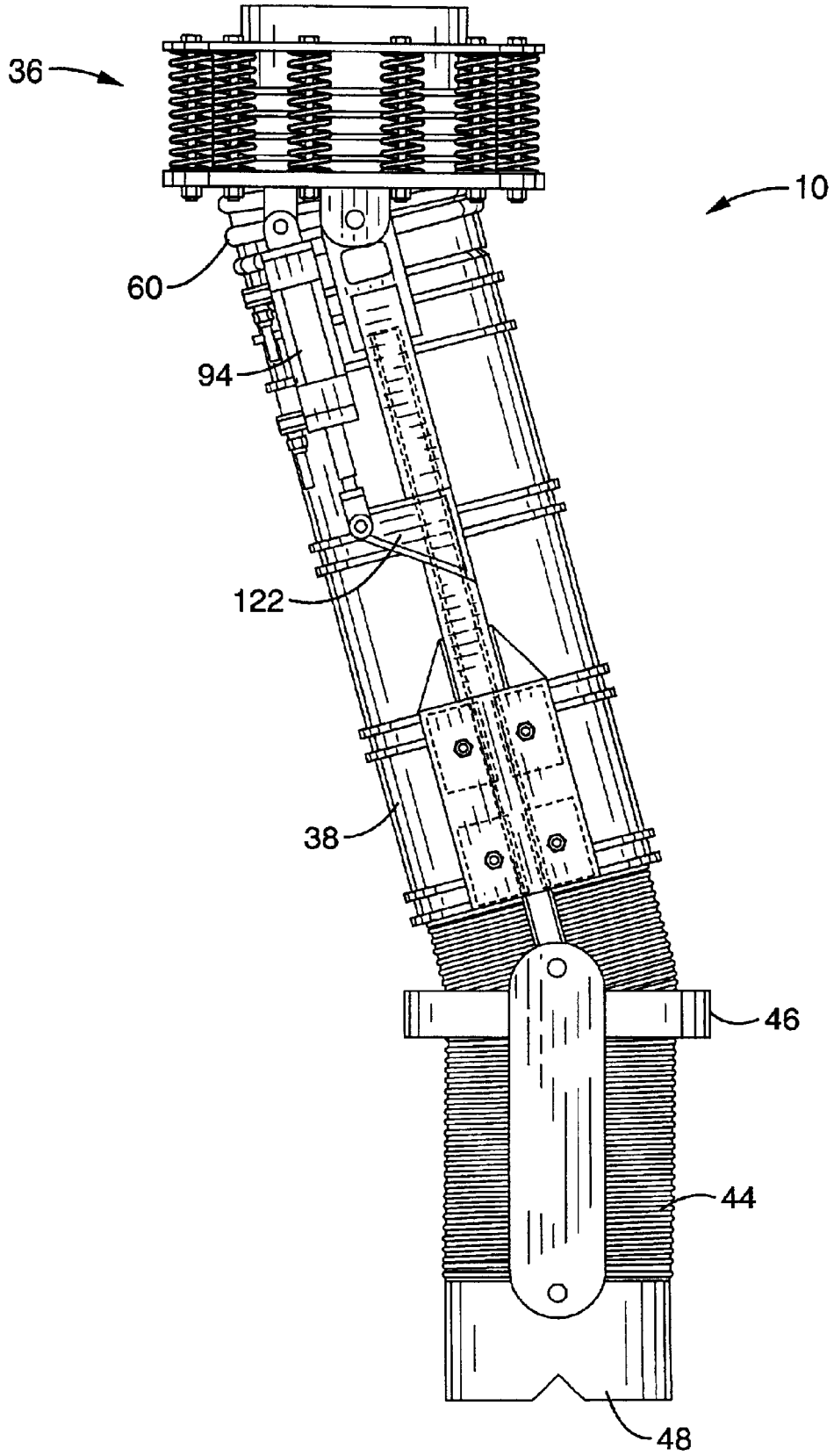
FIG. 14 is an alternative embodiment of the present invention with a flexible hose mounted directly to the base member.

Turning now to FIG. 2, one embodiment of the nozzle assembly 10 of the present invention is shown. The nozzle assembly 10 is coupled to the boom assembly 16 by a boom attachment joint 36. The attachment joint 36 joins a tubular base member 38 of nozzle assembly 10 to the distal end of the boom assembly 16. Base member 38 has an extensible member or fly 40 that moves outwardly and inwardly within base member 38 by the activation of a pair of long hydraulic cylinders 42*a* and 42*b*. It will be appreciated that extensible fly 40 could be a telescoping member as shown, or flexible hosing or the like could be employed as an alternative as shown in FIG. 14. Attached to the distal end of extensible fly 40 are a flexible tube 44, a nozzle bracket 46 and a nozzle tip 48.

Figure 3:
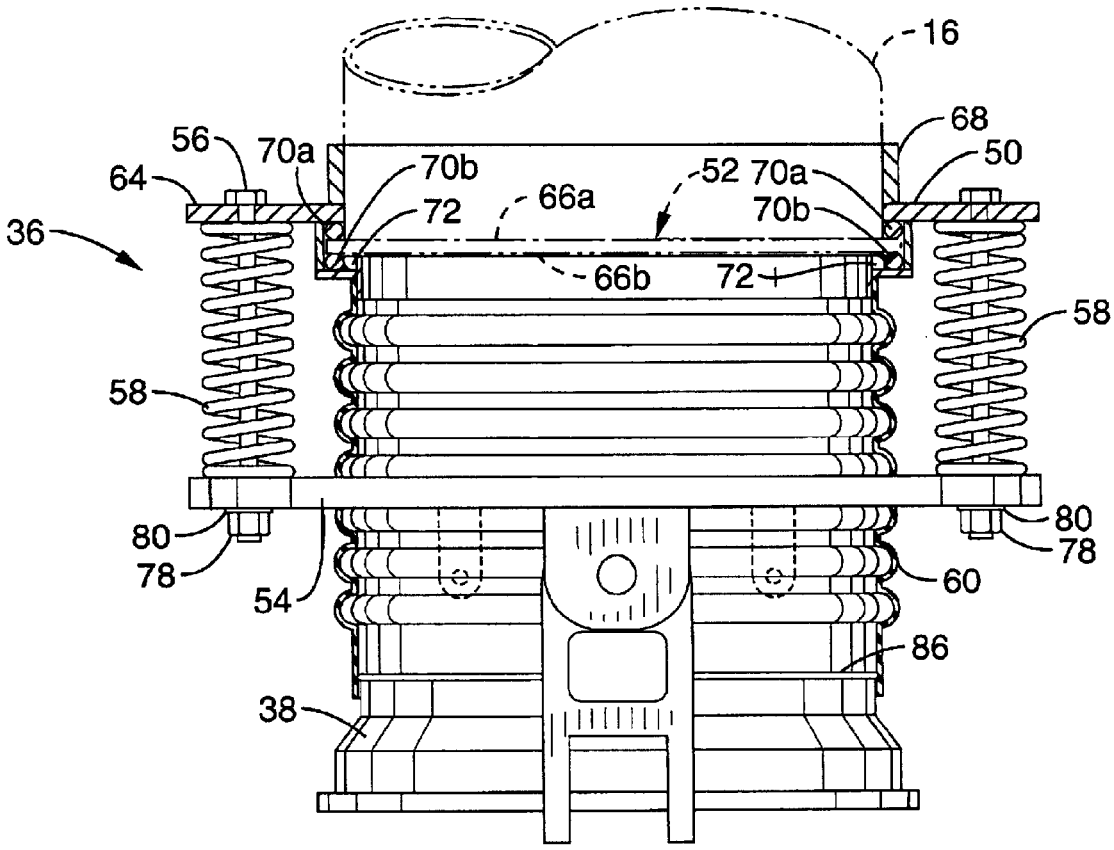
FIG. 3 is a partial cross-sectional view, in side elevation, of the upper tray portion of the upper joint of one embodiment of the nozzle assembly taken along the lines 3—3 shown in FIG. 2 in accordance with the present invention.
Figure 4:
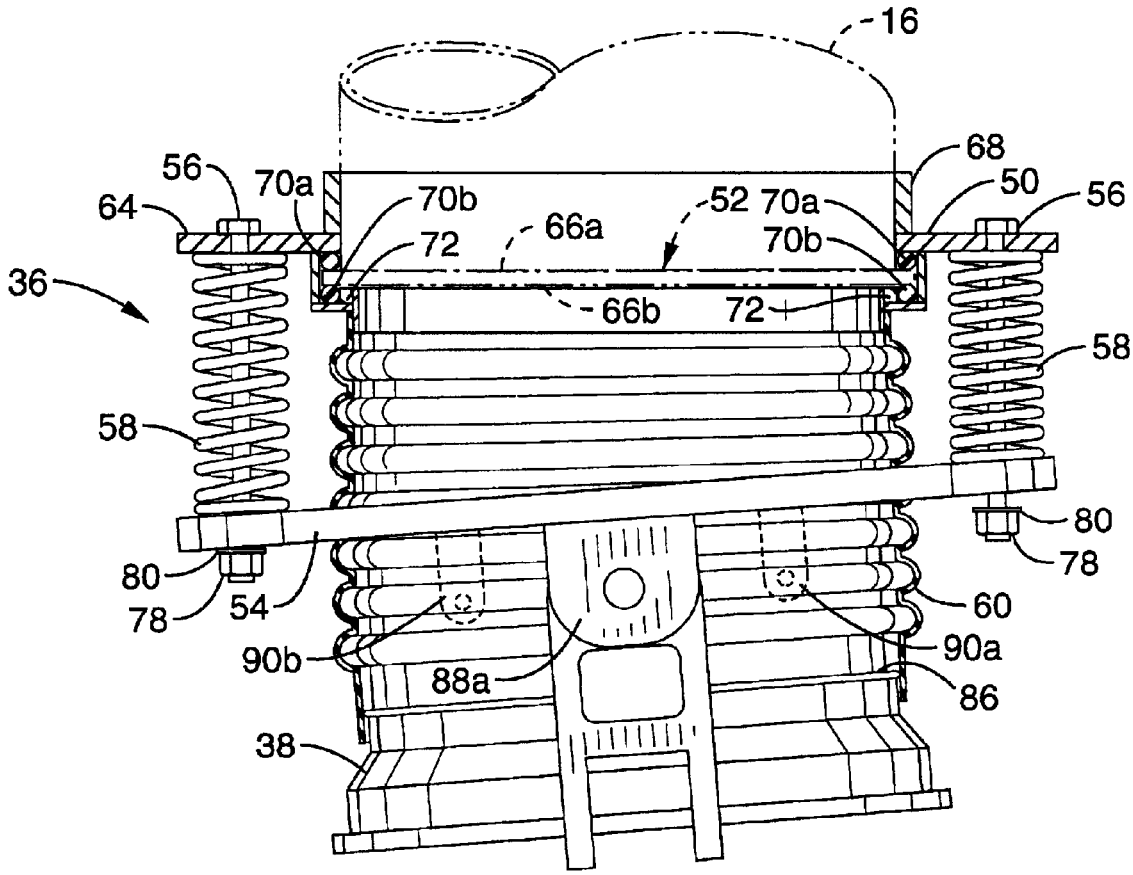
FIG. 4 is a cross-sectional view, in side elevation, of the upper tray portion of the upper joint of the apparatus shown in FIG. 3, shown immediately after the nozzle assembly has impacted an obstacle showing the compliance of the upper joint.

Referring also to FIG. 3 and FIG. 4, it is preferred that the joint 36 between the boom 16 and nozzle assembly 10 allow rotation on several axes and have sufficient compliance to absorb shock loads which the nozzle assembly 10 may encounter from mild collisions during use. To avoid breaking the nozzle assembly 10 off of the overhead boom 16 and otherwise prevent damaging the boom and truck 12 in situations where the assembly 10 collides with a stationary object, it is preferred that the boom joint 36 be capable of absorbing the energy of a collision. It is also preferred that the joint 36 be capable of realigning itself after the impact, without the aid of active controls. However, the stiffness of joint 36 must be sufficient to not break free during normal use.

The boom joint 36 should be capable of supporting the weight of the nozzle assembly 10 as well as allow rotation of the nozzle assembly 10 about a vertical axis with respect to the end of the boom 16. In addition, boom joint 36 should also allow litter to pass from the intake 20 of the nozzle assembly 10 up into the overhead boom assembly 16 without any loss of vacuum suction or infringement of vacuum airflow. A vacuum should be maintained between the top of base 38 and the opening at the end of the boom 16 throughout all motions of the boom joint 36.

Universal type joints known in the art may be an acceptable boom joint but are not preferred because such joints have little capacity for collision energy absorption. The preferred joint 36 has a top tray 50, that is mounted to the cylinder and lip 52 of the distal end of boom assembly 16, and a bottom tray 54 that is coupled to the base member 38 of the nozzle assembly 10. The top tray 50 and the bottom tray 54 are connected by a combination of joint bolts 56 and springs 58. Under normal circumstances, the bolts 56 carry the weight of the bottom tray 54. A flexible vacuum hose 60 within the boom joint 36 connects the boom 16 opening with the top of base 38. The flexible hose 60 between the top of the base 38 and the lower annular flange 74 of the top tray 50 rotates about a vertical axis of motion with the nozzle assembly 10. Thin rubber or felt vacuum seals (not shown) are preferably used around the interior of the top tray 50 to both maintain a vacuum seal and to properly align the top tray 50 with the lip 52 at the end of boom 16.

Figure 5A:
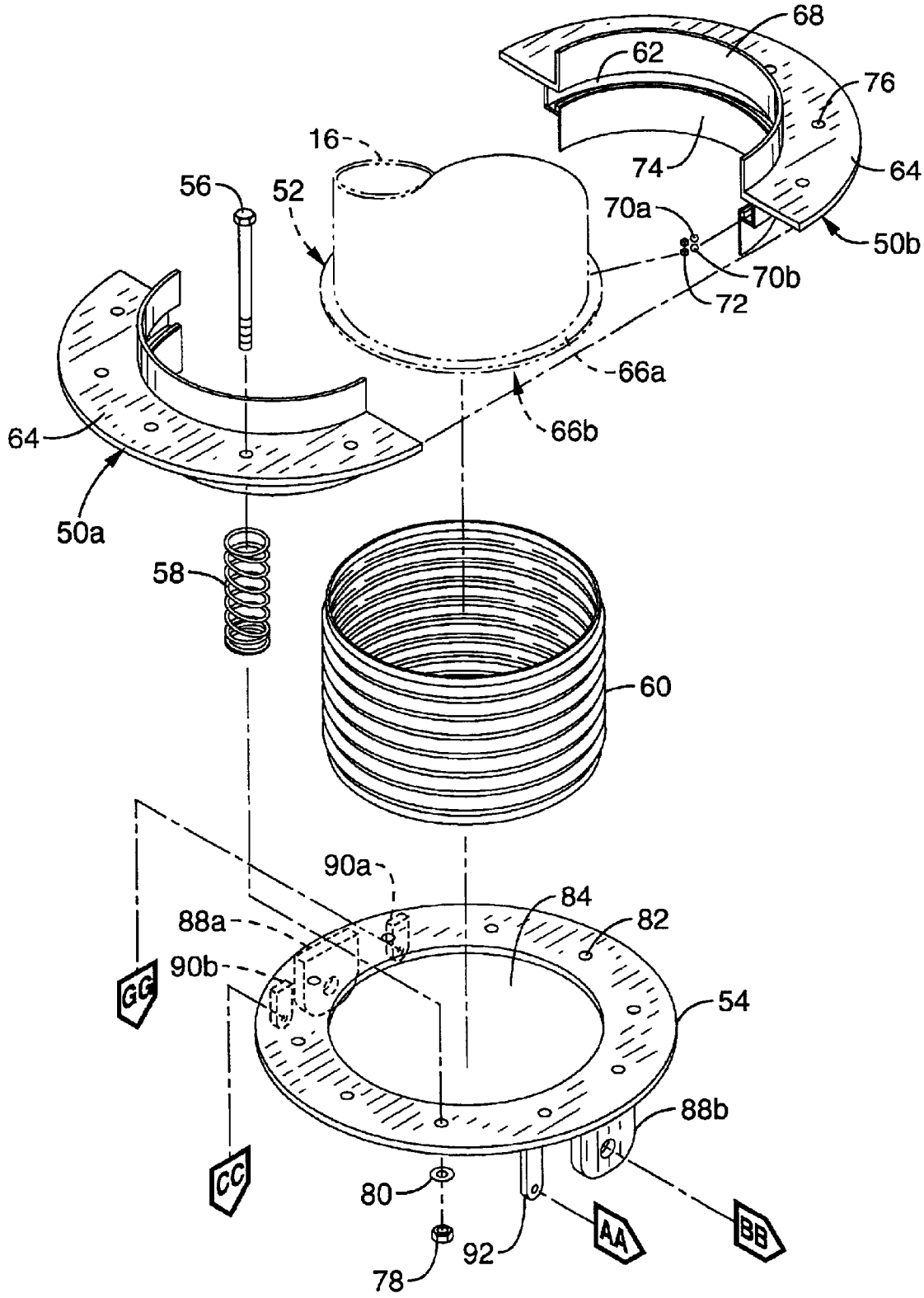
FIG. 5A is an exploded view in perspective of the upper joint of FIG. 2 according to the present invention.

The preferred top tray 50 has two half circular symmetric sections 50*a*, 50*b* that are joined around lip 52. As seen in FIG. 3, FIG. 4, and FIG. 5A the cross section of the top tray 50 has a generally "C" shaped channel 62 and preferably has a circumferential flange 64, that may have a number of supporting gussets (not shown), and an upper annular flange 68. Top Tray sections 50*a*, 50*b* are joined around the boom end lip 52 and the weight of the nozzle assembly 10 is supported on the top surface 66*a* of lip 52 with preferably sets of spherical thermoplastic ball bearings 70*a*, 70*b*, spaced evenly around the circumference of the lip 52 by thermoplastic bar material 72 cut into trapezoidal shapes to properly space the bearings. The thermoplastic material Delrin® is preferably used in place of steel for the ball bearings 70*a*, 70*b* and bar material 72 to avoid the need for lubrication and eliminate rust or corrosion worries in the event that water enters the channel 62.

FIG.3, FIG. 4 and FIG. 5A show the preferred placement of an upper set 70*a* of Delrin® ball bearings that are disposed on the upper surface 66*a* of the lip 52 of the end of boom 60 and within the upper section of channel 62 of top tray 50. Likewise, a lower set 70*b* of Delrin® ball bearings are disposed on the lower surface 66*b* of lip 52 and in the lower section of channel 62 of top tray 50. There is little concern about wear or binding of the bearings 70*a*, 70*b* or spacers 72 within the top tray channel 62 because the upper joint will typically rotate at very slow speeds and at irregular intervals.

The presence of the thermoplastic Delrin® ball bearings 70*a*, 70*b* permits the assembled halves of top tray 50 to rotate along the vertical axis at the boom's end. In the embodiment shown, the upper set of Delrin® ball bearings 70*a* roll against the top inner surfaces of the channel 62, supporting the weight of the nozzle assembly 10. The lower set of Delrin® ball bearings 70*b* then aid in maintaining the vertical position of top tray 50 with respect to the boom lip 52, especially in cases where the nozzle assembly 10 strikes a fixed object, transmitting loads through the springs 58 and into the boom 16.

The outer diameter of flange 64 of the top tray 50 may have a plurality of spring bosses (not shown) welded to its underside. Bores 76 are coaxial with the bosses and receive the long bolts 56 that support the bottom tray 54. In one embodiment, the bores 76 are preferably oversized to allow the bolts 56 to shift in the event the nozzle assembly 10 collides with a fixed object, thus causing the bottom tray 54 to tilt with respect to the top tray 50. The top tray 50 and the bottom tray 54 normally remain parallel to one another as seen in FIG. 3.

Referring specifically to FIG. 4, in the event that the end 48 of the nozzle assembly 10 collides with a fixed object, the forces on the assembly 10 are transmitted through the lower tray 54 and into the springs 58 that line the circumferential flange 64 of the top tray 50 of the upper joint 36. It is preferred that the springs 58 are pre-loaded so that the assembly 10 will not shift unless a collision occurs, and to aid in re-alignment after a collision. The number, size and pre-load of the springs 58 may vary depending on the estimated overload or impact force that may be experienced in the event the nozzle assembly 10 strikes a fixed object.

The partial cross-section of FIG. 4 shows the top and bottom tray assembly shifted during a collision of the nozzle assembly 10 with an obstruction. Impact or excessive static loads on the nozzle assembly 10 will be transmitted through the body of the assembly and into the bottom tray 54. Compression of a number of springs 58 will prevent these forces from being transmitted into the overhead boom 16. When the load is removed, the joint 36 will automatically reset as the springs 58 expand until the bottom tray 54 is again constrained against bolts 56 and nuts 78.

By allowing the springs 58 to extend above the boom lip 52, larger springs can be used thereby increasing the energy absorbing capacity of the joint 36. Thus there is adequate upper joint 36 compliance, in the embodiment shown, to permit the nozzle assembly 10 to move through its entire intended range of motion without compromising the vacuum seal.

As seen in FIG. 3, FIG. 4 and FIG. 5A, there is an annular retaining ring 74 at the bottom of the top tray 50 that serves as a connecting surface for the flexible vacuum hose 60 that will maintain the vacuum airflow between the boom 16 and the top of the base member 38. Optionally, adhesive backed felt or rubber (not shown), may be applied to the top of the retaining ring to ensure a good seal between the boom 16 vacuum opening and flexible hose 60. When assembled on the boom 16 of the base vehicle 12, the top of the retaining ring 74 preferably sits directly below the boom lip 52. The felt material may be applied to close any gaps, and will subsequently rub the lower surface of the boom 16, maintaining a vacuum seal as the top tray 50 is made to rotate on the lip 52 of the end of boom 16.

The bottom tray 54 supports the base member 38 and allows the base to pivot. The bottom tray 54 is sized to permit centerline clearance of the upper flexible vacuum hose 60, and to accept and support the compression springs 58; joint bolts 56 and nuts 78 with washers 80. The long bolts 56 that pass through the bores 76 of top tray 50 continue downward through the compression springs 58 and through the preferably counter bored holes 82 in the bottom tray 54.

In one embodiment, the bolts 56 are threaded with self-locking nuts 78 such as Ny-Lock® nuts or the like. Consequently, the annularly disposed bolts 56 carry the weight of the bottom tray 54 plus the pre-load force of the springs 58. Thus, in cases where the bottom tray 54 shifts upward with respect to the top tray 50 as shown in FIG. 4, the tensile load on a portion of the bolts 56 will be temporarily removed until the springs 58 return the system to its normal state. Ny-Lock type nuts 78 are preferred to prevent a fastener from working its way off of a bolt 56 through repeated vibration cycles. The symmetric counter bores and through holes 82 in the bottom tray 54 keep the weight relatively low and evenly distributed.

The opening 84 in the center of the bottom tray 54 permits the placement of the flexible vacuum hose 60 between the bottom annular ring 74 of the top tray 50 and the top 86 of the base member 38. The size of the opening 84 in lower tray 54 is preferably larger than the diameter of the flexible hose 60. This clearance is necessary to permit bending of the hose 60 along the long axis as the base 38 swings underneath tray 54. In one embodiment, the opening 84 is oval in shape.

Figure 5B:
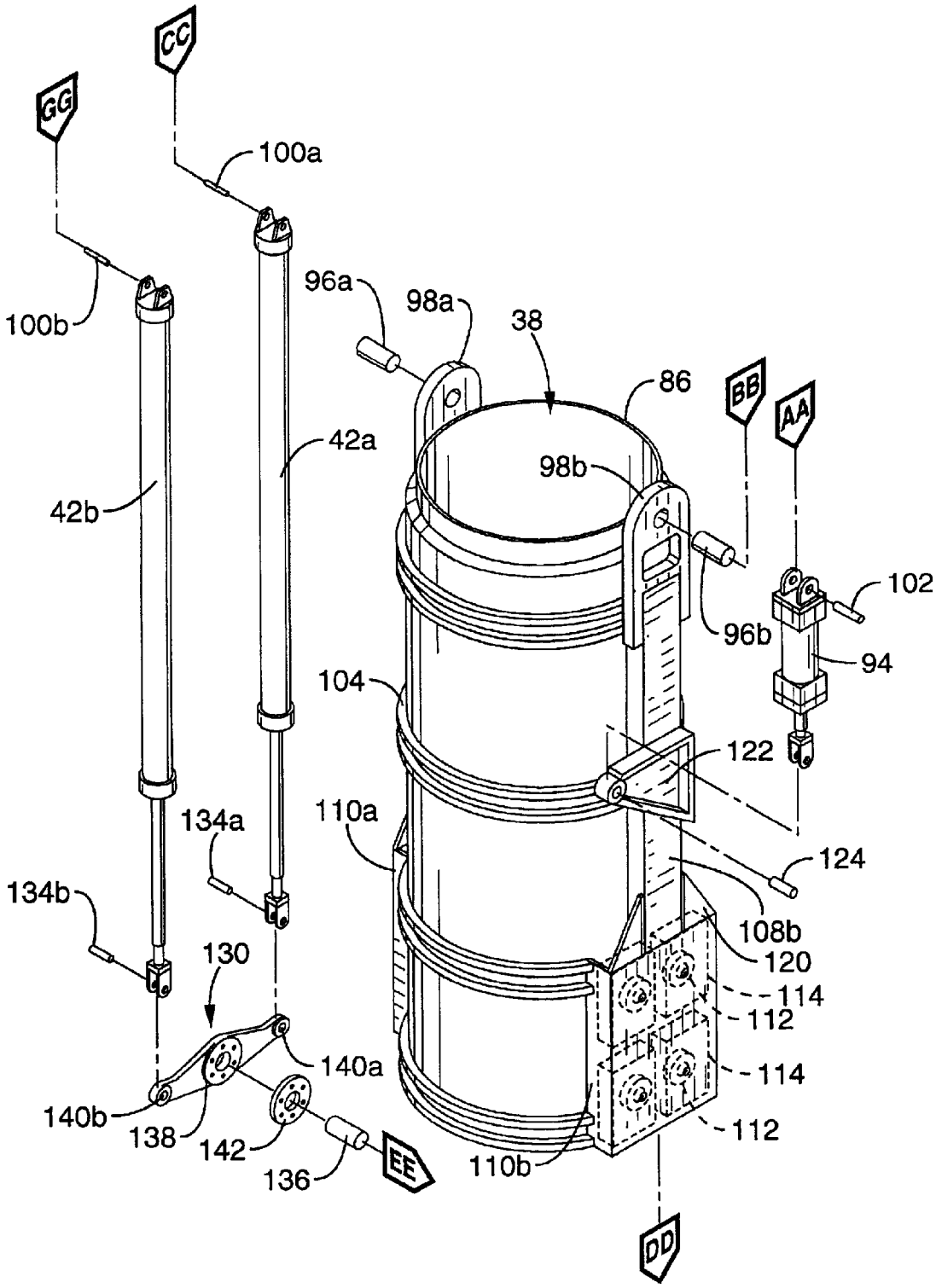
FIG. 5B is an exploded view in perspective of the base member of the nozzle assembly of shown in FIG. 2.

Referring also to FIG. 5B, it can be seen that the bottom tray 54 has mounts welded to the underside for pivotally coupling all actuation cylinders and the base member 38 to the bottom tray 54. Since the base 38 is configured to swing beneath boom attachment joint 36, bottom tray 54 has two base attachment mounts 88*a* and 88*b* aligned on opposing sides of the tray 54. A pair of cylinder mounts 90*a*, 90*b* for attachment of the long cylinders 42*a*, 42*b* are aligned along the underside of the bottom tray 54 preferably in the same vertical plane as base 38 attachment mount 88*a*. Finally, short cylinder mount 92 for attachment of the short cylinder 94 is preferably aligned in the same vertical plane as base mount 88*b*.

In one embodiment, brass sleeve bushings (not shown) and swing pins 96*a*, 96*b* are provided to reduce wear on the steel mounts 88*a*, 88*b* of bottom tray 54 as well as base mounting crowns 98*a*, 98*b* of base assembly 38. Two stainless steel pins 96*a*, 96*b* are then used to support the base 38. The pins 96*a*, 96*b* are preferably fitted with grease caps, drilled, and turned to form grease pathways that will aid in lubricating these rotating joints (not shown). Optionally, shaft collars (not shown) may be welded to the outermost flanges with setscrews to secure the pins 96*a*, 96*b* in place. Thus, the base 38 is free to rotate on the pins 96*a*, 96*b* and the turned grease path on the pins is aligned to lubricate the brass bushings installed in the base crowns 98*a*, 98*b*.

Similarly, bottom tray mounting flanges 90*a*, 90*b* and 92 of bottom tray 54 preferably have press-fit brass bushings that will hold the greased long cylinder top pins 100*a*, 100*b* and top pin 102 of the short-stroke cylinder 94 to couple the respective cylinders to the bottom tray 54.

The base member 38 is a large diameter, rigid open tube that supports the extensible fly 40 and preferably permits vacuum airflow through its interior without being unreasonably heavy. In the embodiment shown, there are optionally eight rings 104 that stiffen the base 38 and maintain its circularity. The top tube portion 86 of the base 38 is an attachment point for the top flexible vacuum hose 60.

Figure 5C:
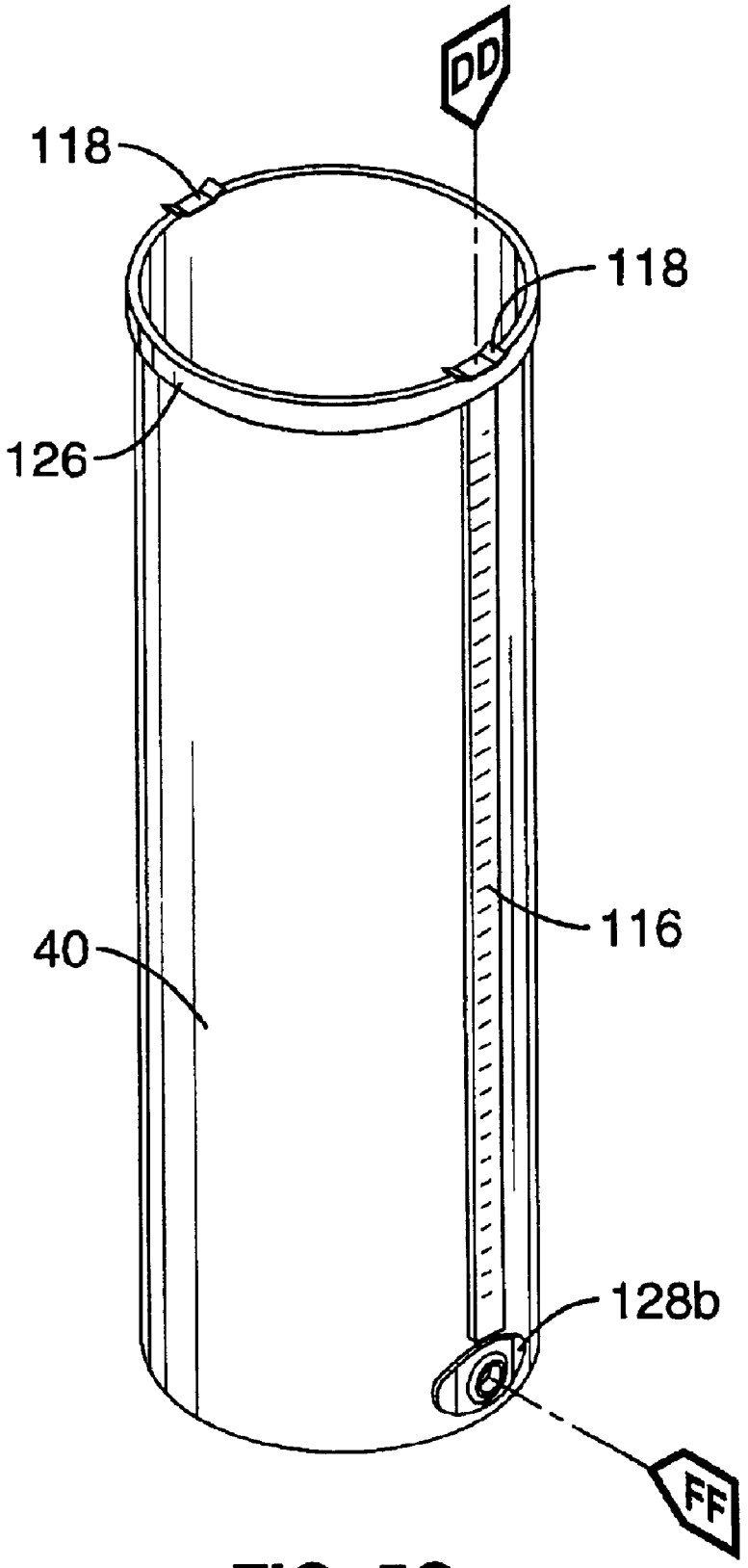
FIG. 5C is a perspective view of the fly section of the nozzle assembly of FIG. 2 that telescopes from the base member shown in FIG. 5B according to the present invention.
Figure 6:
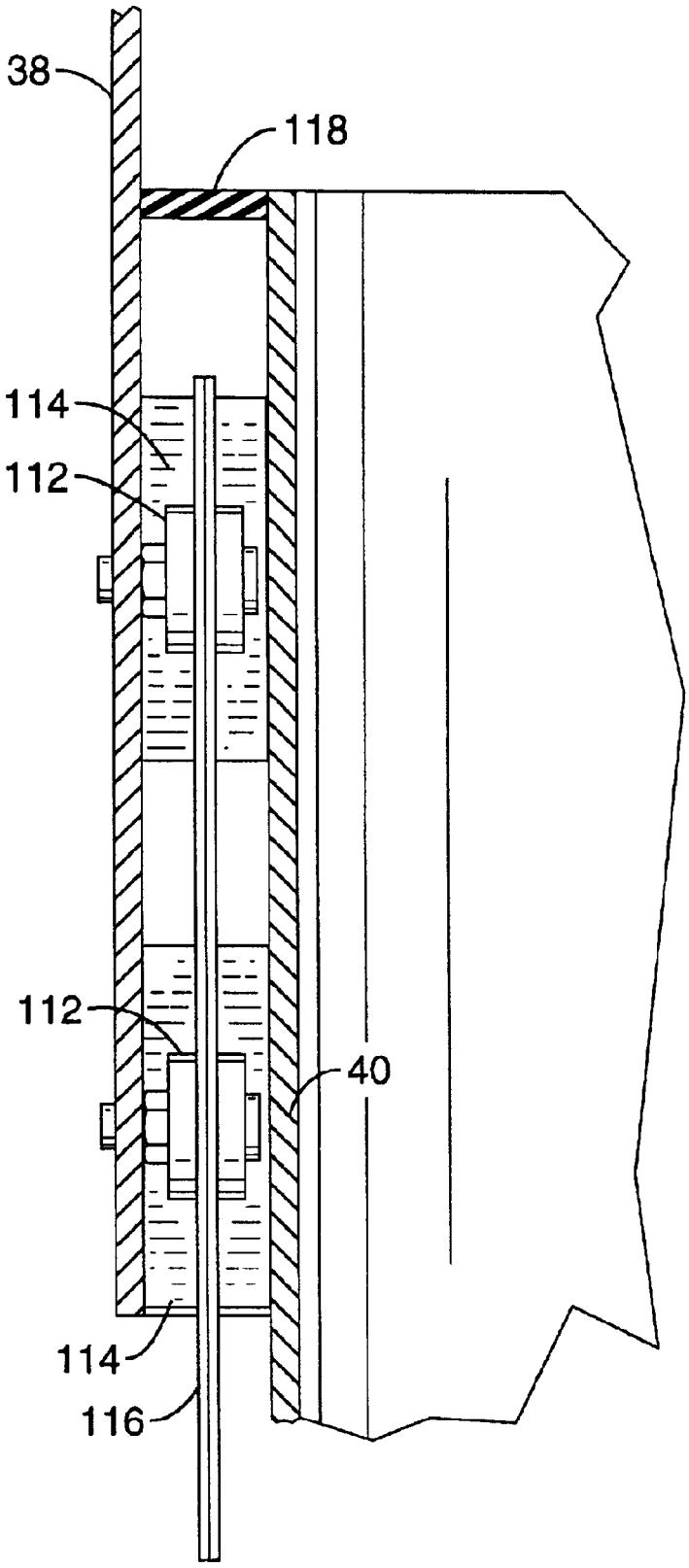
FIG. 6 is a partial cross-sectional side view of one section of the base member and extensible fly joint of the nozzle assembly of FIG. 2 taken along lines 6—6.

Referring also to FIG. 5C and FIG. 6, in the embodiment shown, extensible fly 40 slides within a pair of longitudinal channels 108*a*, 108*b* in the base member 38. The long, narrow channels 108*a*, 108*b* fulfill two roles. First, the channels 108*a*, 108*b* provide clearance for the roller track 116 attached to the fly 40 as it is made to retract into the base 38. Secondly, the channels provide structure to support the bending moment that pivots the base 38 and swings the nozzle assembly 10 below the upper joint 36 around pins 96*a*, 96*b*. It is also preferred that base crowns 98*a*, 98*b* are mounted to the proximal end of channels 108*a*, 108*b* for coupling with bottom tray mounts 88*a*, 88*b*.

Attached to the long channels 108*a*, 108*b* are shorter, wider channels 110*a*, 110*b* and are preferably the mounting platforms for the roller journals 112 and cap seals 114 that clean the roller track 116 of fly 40. Rubber cap seals 114, preferably constructed with oil impregnated felt pads, fit over the roller journals 112 and lubricate and clean the roller track 116 as it is moved and protects the journals 112 from contaminants as seen in FIG. 5*b*. In one embodiment, thin metal washer type shims (not shown) may be used to adjust the spacing between the journals 112 and the interior wall of the short channels 110*a*, 110*b*. Adjustment of the shims assures coaxial alignment of the fly 40 within the base 38.

In order to further maintain a vacuum inside the base 38, the top ends of the long channels 108*a*, 108*b* are preferably capped sheet metal. Gussets 120 may be welded in the pockets between the long and short channels to more evenly transition the moment loading between the base 38 and fly 40 sections.

Base 38 also has a triangular flange 122 preferably welded to the face of the front long channel 108*b* that permits attachment of the bottom end of the short-stroke cylinder 94. Short stroke cylinder 94 is coupled to triangular flange 122 with a pin 124 and to mount 92 of the bottom tray with pin 102. In this configuration, forces that are developed through actuation of the short cylinder 94 are transmitted into the base 38 thereby causing the nozzle assembly 10 to swing beneath the bottom tray 54. Like the other pin joints previously described, pin 124 preferably fits with a press-fit brass bushing in flange 122.

The fly 40 is preferably a straight steel tube with a pair of roller tracks 116 mounted longitudinally on fly 40 that facilitate its telescopic motion into and out of the base 38. In one embodiment, tracks 116 are made from square steel bars welded to "V" edged tracks and mounted to the tube diametrically opposite each other. These bars permit mounting of the "V" track to the fly 40.

A vacuum must be maintained within the fly 40 and base 38 for proper debris transport into the overhead boom 16. To accomplish this, vacuum seals are preferably fabricated to close the gap between the top of the fly 40 and the inside of the base 38. As seen in FIG. 5C, one or more circumferential seals 126 are attached to the top surface of the end of fly 40. Seal 126 wipes along the interior of the cylindrical tube of the base 38, while seals 118 wipe along the interior of the long, narrow channels 108*a*, 108*b*. Thus, channel seals 118 and the circumferential seal 126 seal the interior of the base 38 as the fly 40 is extended, significantly restricting vacuum airflow and subsequent pressure losses through the channels 108*a*, 108*b* and around the exterior of the fly 40.

Figure 5D:
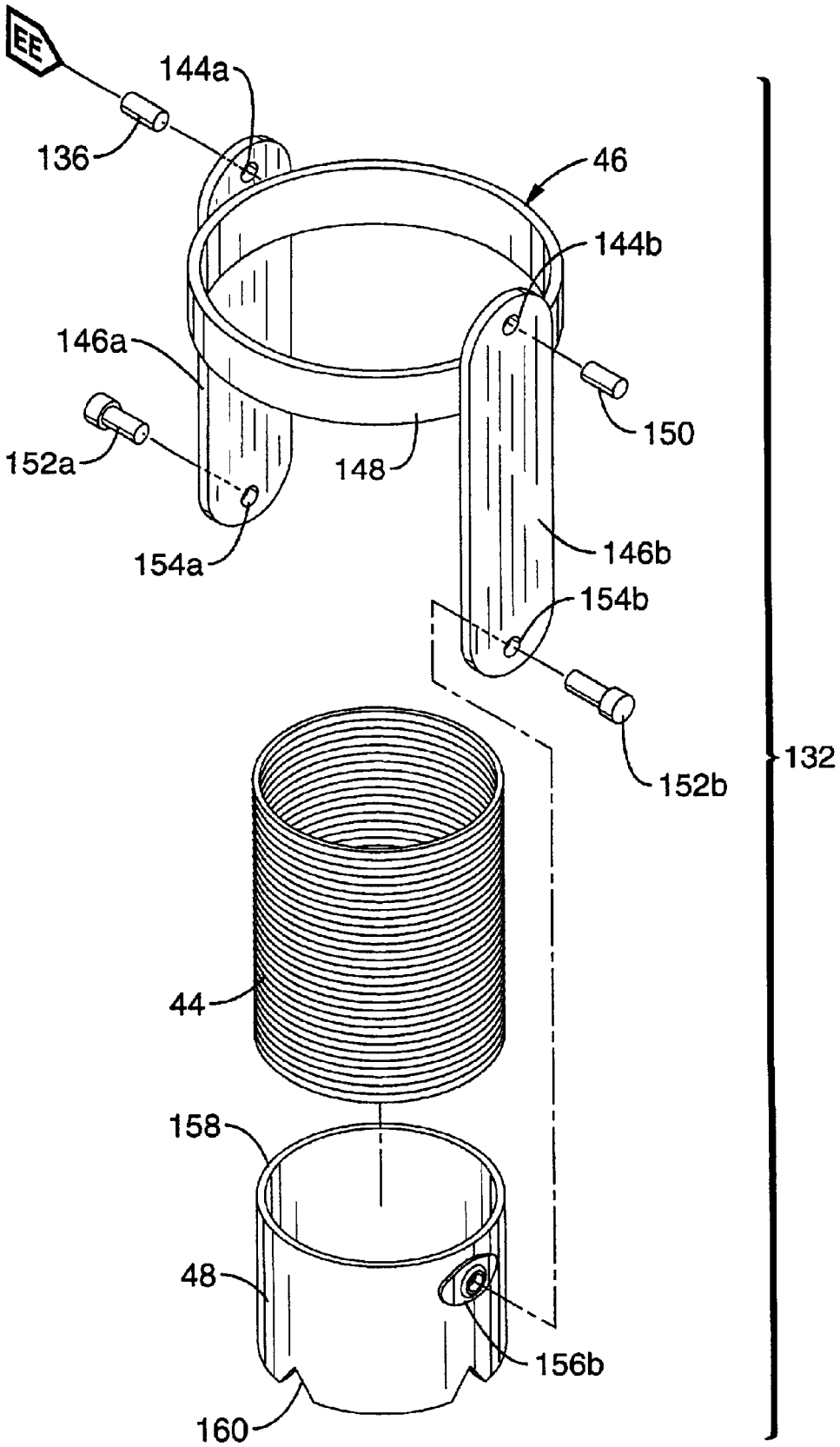
FIG. 5D is an exploded perspective view of the nozzle bracket assembly of the nozzle assembly of FIG. 2 according to the present invention.

Referring now to FIGS. 5B and 5D, the long stroke cylinder flange 130 is the junction between the twin long-stroke cylinders 42*a*, 42*b*, the nozzle bracket assembly 132, and the fly 40. Cylinder flange 130 is an elongate member with a central pivot sleeve 138 and sleeves 140*a*, 140*b* at respective ends of the cylinder flange 130. It is preferred that sleeves 138, 140*a* and 140*b* of the cylinder flange 130 be sized to accept press-fit brass sleeve bushings. The central pivot sleeve 138 receives lift pin 136 and sleeves 140*a* and 140*b* will receive the lower pins 134*a*, 134*b* of the long-stroke cylinders 42*a*, 42*b* respectively. In the embodiment shown, there are six holes drilled around the center hole of the cylinder flange 130 to permit fastening of the flange 130 to the nozzle bracket 46. Optionally, a spacer 142 fits between the nozzle bracket 46 and the cylinder flange 130.

Lift pin 136 is disposed in sleeve 138 of cylinder flange 130, spacer 142, bracket sleeve 144*a* of nozzle bracket 46 and sleeve 128*a* of fly 40. The lift pin 136 may be held in place by a fastener threaded through the pin sleeve 138 and into a notch in the pin itself (not shown).

Turning specifically to FIG. 5D, the preferred nozzle bracket assembly 132 can be generally seen. The nozzle bracket assembly 132 includes the nozzle bracket 46 and a flexible tube 44 that is coupled to nozzle tip 48. The nozzle bracket 46 preferably has two elongate arms 146*a*, 146*b* coupled to a circular frame 148. Nozzle bracket 46 132 preferably has four bearings or sleeves in arms 146*a*, 146*b* positioned on opposite sides of a circular frame 148. Sleeve 144*a* of arm 146*a* of the nozzle bracket 46 receives lift pin 136. Directly opposite sleeve 144*a* is sleeve 144*b* that receives top dowel pin 150, which pivotally couples arm 146*b* of nozzle bracket 132 to sleeve 128*b* of the distal end of fly 40. The dowel pin 150 and the lift pin 136 together support the nozzle bracket assembly 132, while the lift pin 136 also serves as a connection to the long-stroke cylinders through cylinder flange 130. These pins also provide a pivotal axis that permits rotational motion of the nozzle bracket assembly 132. Lower dowel pins 152*a*, 152*b* are disposed in sleeves or bearings 154*a*, 154*b* respectively. The lower dowel pins 152*a*, 152*b* pivotally couple the arms 146*a*, 146*b* of the nozzle bracket with the nozzle tip 48 through the tip bearings 156*a*, 156*b* respectively. The pins 152*a*, 152*b* are preferably free to rotate in the flange bearings 156*a*, 156*b*.

In the embodiment shown, the three dowel pins 150, 152*a*, 152*b* and lift pin 136 are fixed with respect to the nozzle bracket 46 and permit rotation of the bracket assembly 132 with respect to the fly 40, as well as rotation of the nozzle tip 48 with respect to the bracket arms 146*a*, 146*b* of bracket 46. In one embodiment, the lower pins 152*a*, 152*b* are not greased and ride in the nylon portions of the flange bearings 154*a*, 154*b* on the nozzle tip 48.

The distal end of fly 40 preferably protrudes beyond the pin mounts 128*a*, 128*b* so that a second section of flexible hose material 44 may be mounted to the distal end of the fly 40. This flexible hose 44 connects and maintains the vacuum between the lower end of the fly 40 and the top rim 158 of the nozzle tip 48.

The nozzle tip 48 is preferably a short section of thin walled steel tubing. In the embodiment shown, nozzle tip 48 has a number of notches 160 that are cut into the lower end of the tip 48. These notches 160 permit continuous airflow in cases where the nozzle tip 48 is very near or on the ground. Continuous airflow is necessary to avoid the strength of the vacuum from drawing the nozzle tip 48 firmly against the ground, which could require powering down the vacuum to remove the nozzle from the ground. It will also be understood that the nozzle tip 48 may be configured with a nozzle assist device such as a rake, brushes, compressed air jets, shredders and the like that can assist in the movement of litter items toward the intake 20 of the nozzle tip 48 of the nozzle assembly 10.

Overall, the nozzle bracket 46 supports the nozzle tip 48 and adds an extra degree of freedom to the nozzle assembly 10. In the embodiment shown, the rotation of the nozzle tip 48 is passive on the lower axis about pins 152*a*, 152*b* of bracket 46. Accordingly, the stiffness of the hose 44 will determine how far the nozzle tip 48 rotates with respect to the bracket arms 146*a*, 146*b* as the bracket assembly 132 itself is made to rotate under the fly 40. By allowing the rotation of nozzle tip 48 on the bracket 46 to be passive, many minor collisions between the nozzle assembly 10 and fixed objects will merely shift the nozzle tip 48 on its axis around pins 152*a*, 152*b* without affecting the remainder of the nozzle assembly 10.

Figure 7:
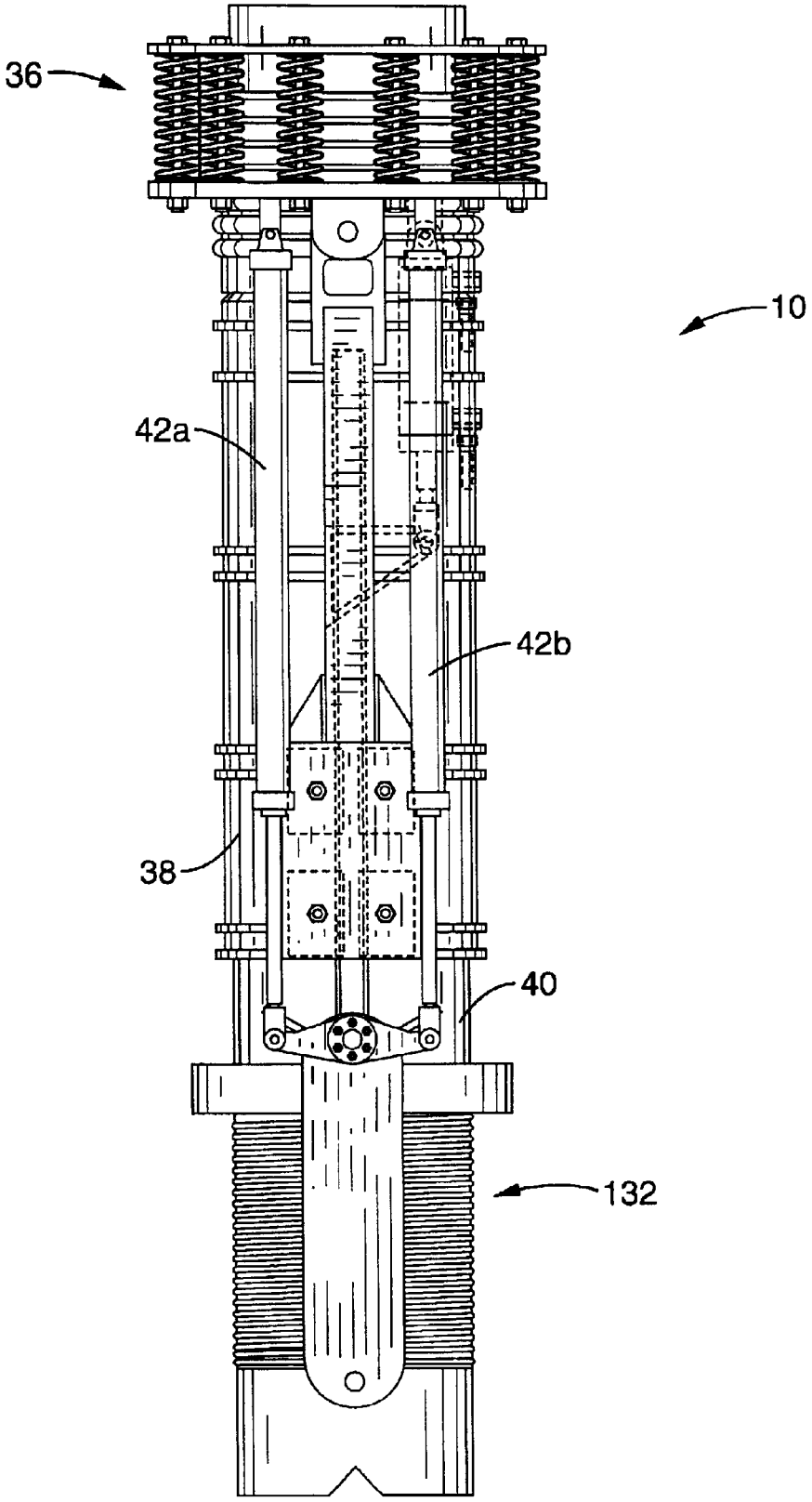
FIG. 7 is a left side view of the nozzle assembly shown in FIG. 2 according to the present invention with the fly in the fully retracted position.
Figure 8:
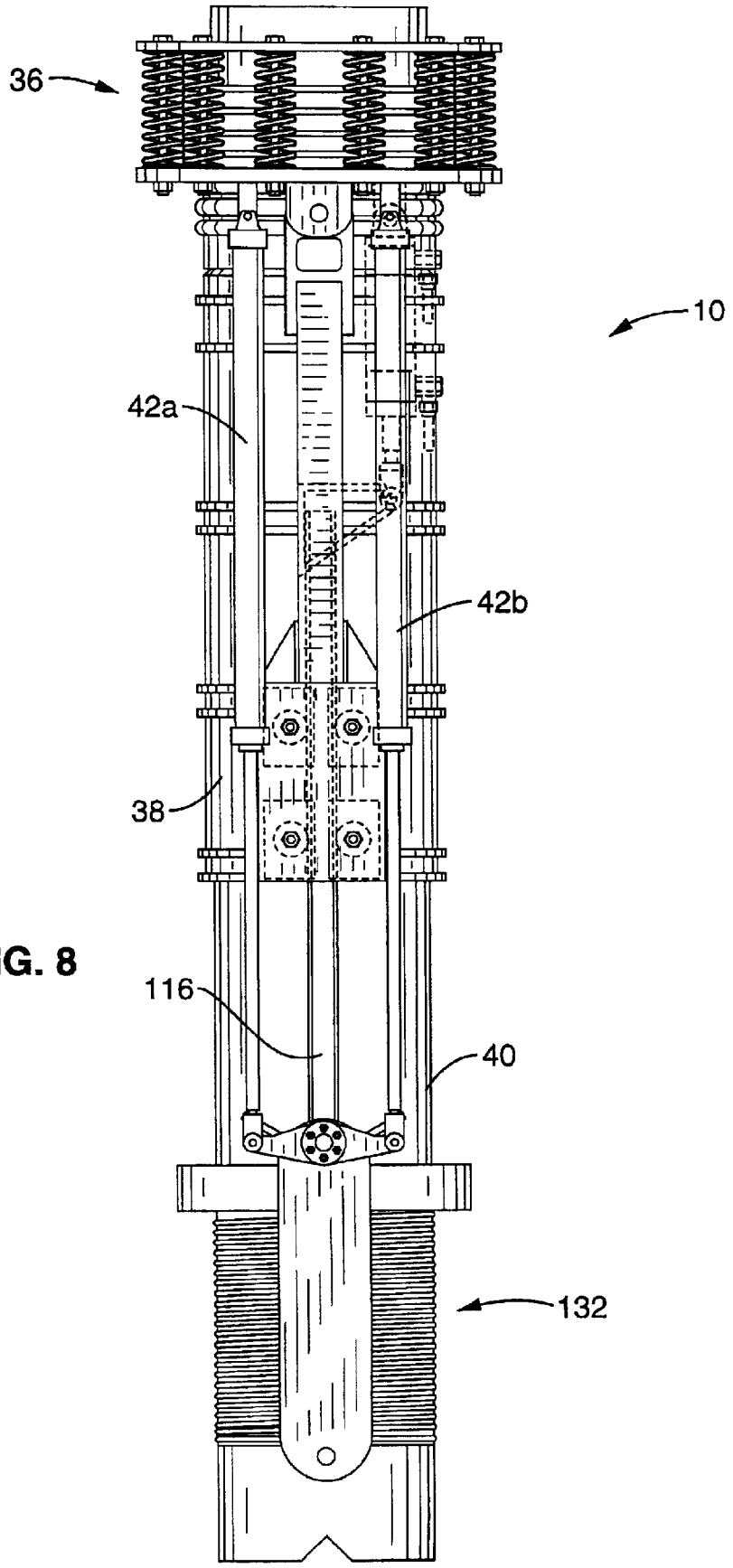
FIG. 8 is a left side view of the nozzle assembly shown in FIG. 2 according to the present invention with the fly in the fully extended position.
Figure 9:
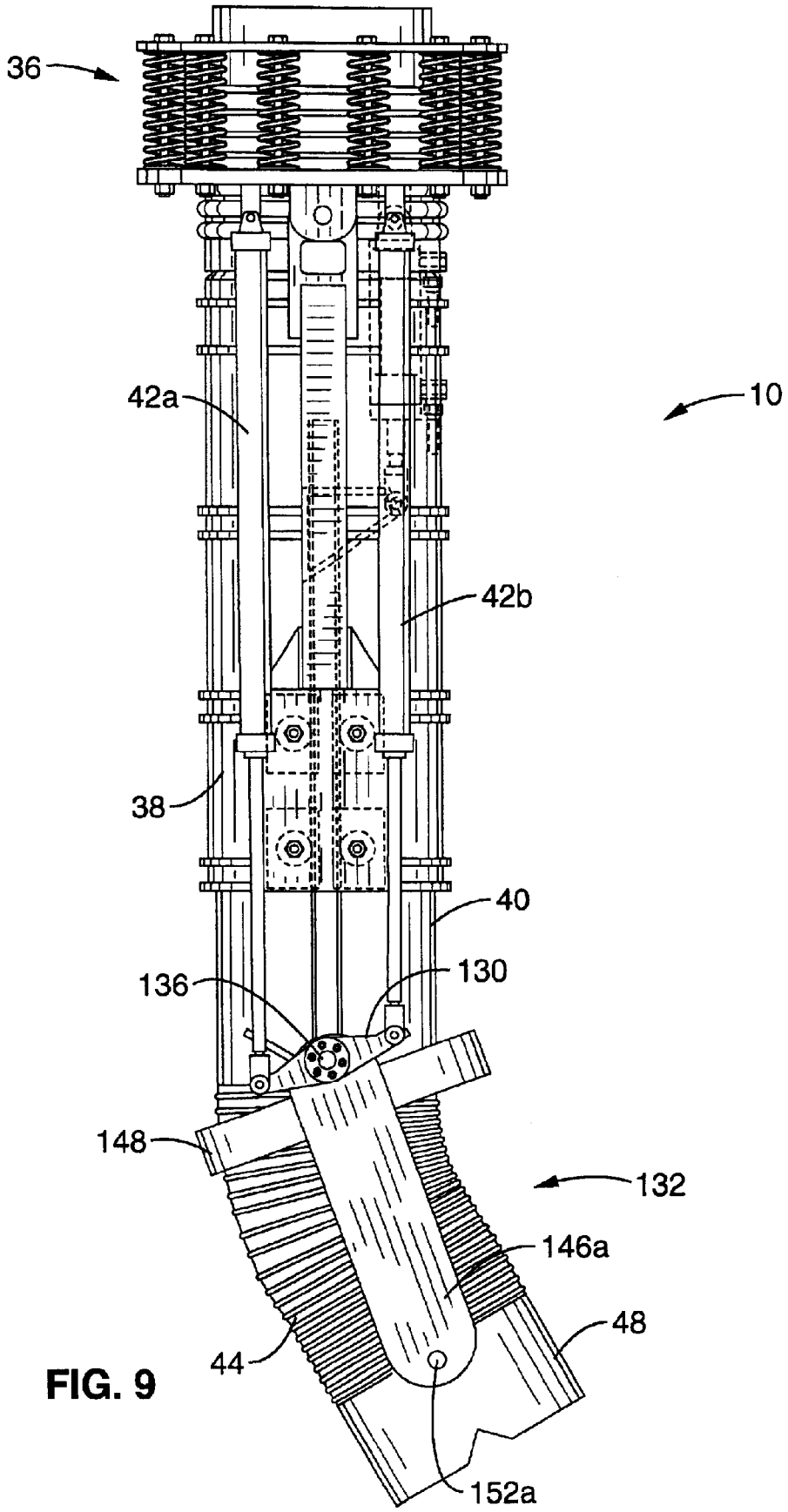
FIG. 9 is a left side view of the nozzle assembly shown in FIG. 2 according to the present invention with the long cylinders at unequal lengths and showing one articulation of the nozzle bracket assembly.

Turning now to FIG. 7, FIG. 8 and FIG. 9, the movements of the fly 40 and nozzle bracket assembly 132 by activation of the long cylinders 42*a*, 42*b* are shown. It can be seen that the lift pin 136 will transmit the fly extension and retraction forces from the long-stroke cylinders 42*a*, 42*b*, through cylinder flange 130, lift Pin 136, and into the fly 40, thus controlling the position of fly 40 with respect to the base 38.

In FIG. 7, the long cylinders 42*a*, 42*b* are fully retracted and the fly 40 is fully retracted within base 38 as a consequence.

As seen in FIG. 8, the simultaneous, equal extension of the long cylinders 42*a*, 42*b* causes vertical translation of the center point of the flange 130. This carries with it the lift pin 136 that supports the bracket 132 and the fly 40, thus extending or retracting these elements. Cylinder flange 130 is the bottom end of a four-bar linkage between the long-stroke cylinders 42*a*, 42*b* and the mounts 90*a*, 90*b* welded to the bottom tray 54 of the upper joint 36.

Because the nozzle bracket 132, spacer 142, and cylinder flange 130 are free to rotate about the axis of lift pin 136 and dowel pin 150, the nozzle bracket 132 will rotate about the axis when the long cylinders 42*a*, 42*b* are actuated in opposite senses as seen in FIG. 9. The nozzle bracket 132 can be pivoted in either direction depending on the relative length of the extension of the cylinders 42*a*, 42*b*.

Furthermore, when the opposed motion of the two long-stroke cylinders 42*a*, 42*b* causes rotation of the flange 130 and bracket 46, the vertical position of the lift pin 136 remains constant thereby maintaining the height of the fly 40 and nozzle bracket assembly 132 during rotation. Thus, the fly 40 can be extended or retracted at the same time that the nozzle bracket assembly 132 is rotated.

Figure 10:
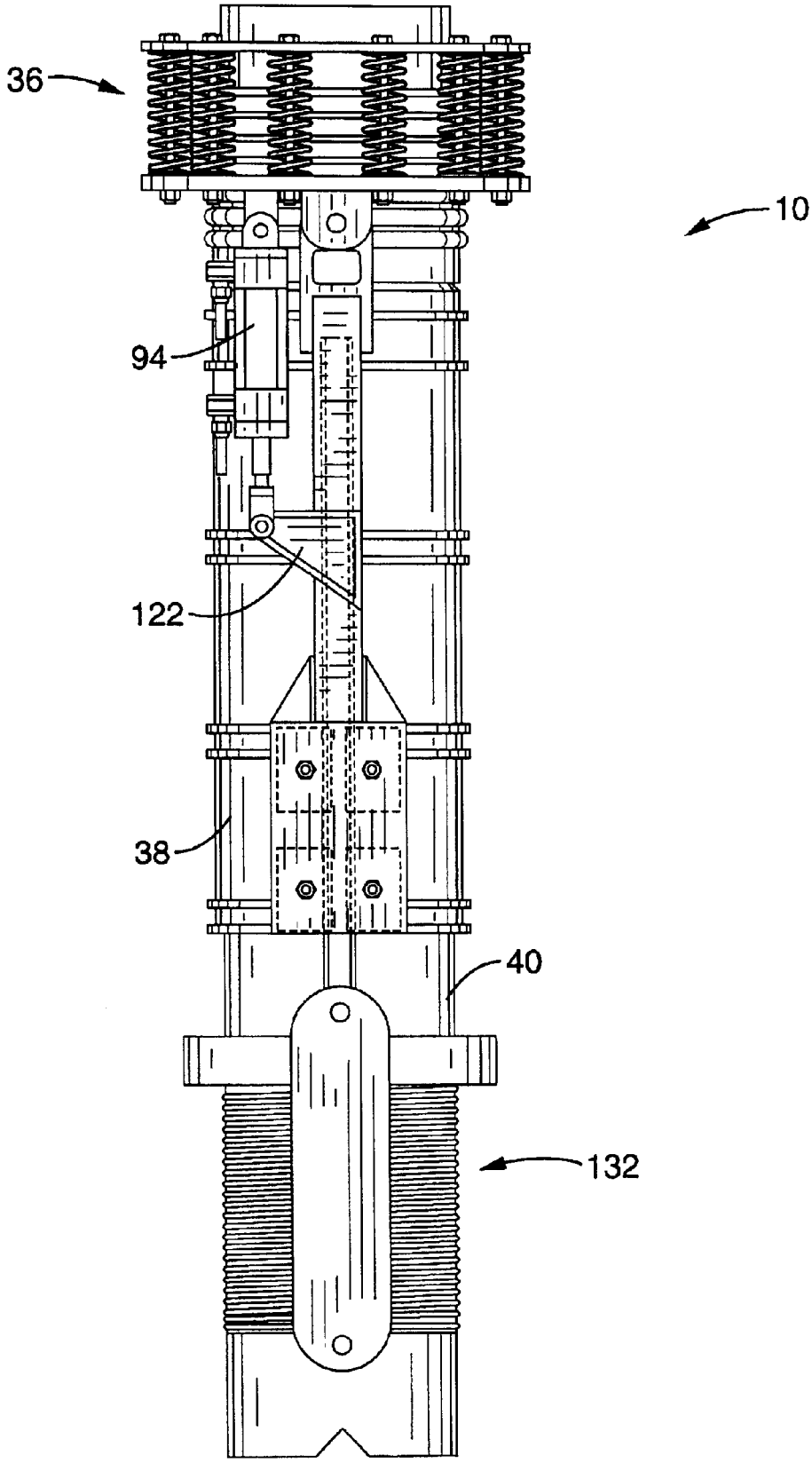
FIG. 10 is a right side view of the nozzle assembly shown in FIG. 2 according to the present invention with the short cylinder in the midway or partially retracted position.
Figure 11:
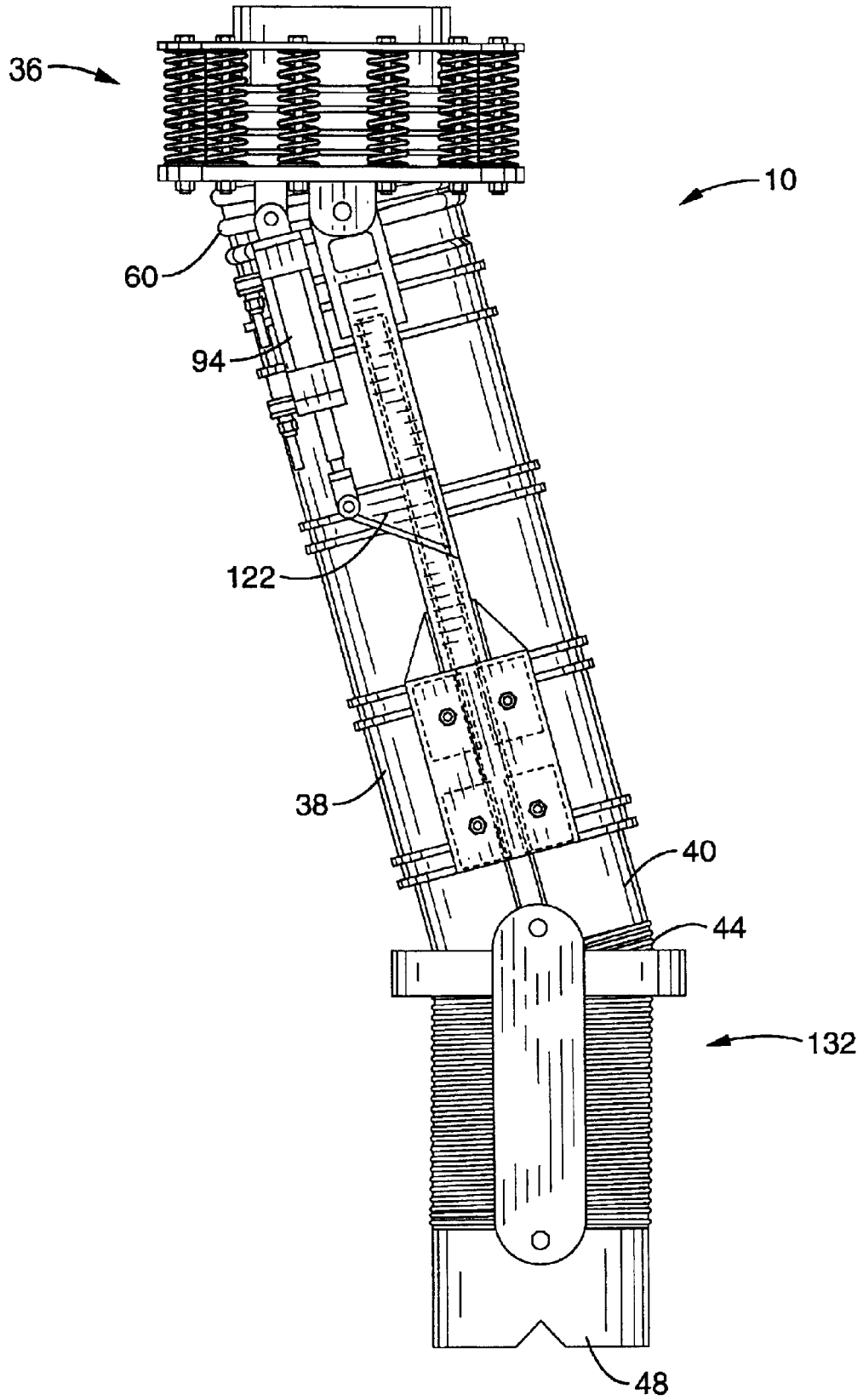
FIG. 11 is a right side view of the nozzle assembly shown in FIG. 2 according to the present invention with the short cylinder in the extended position and the long cylinders at equal lengths and showing the simultaneous articulation of the nozzle bracket assembly and the base member.
Figure 13:
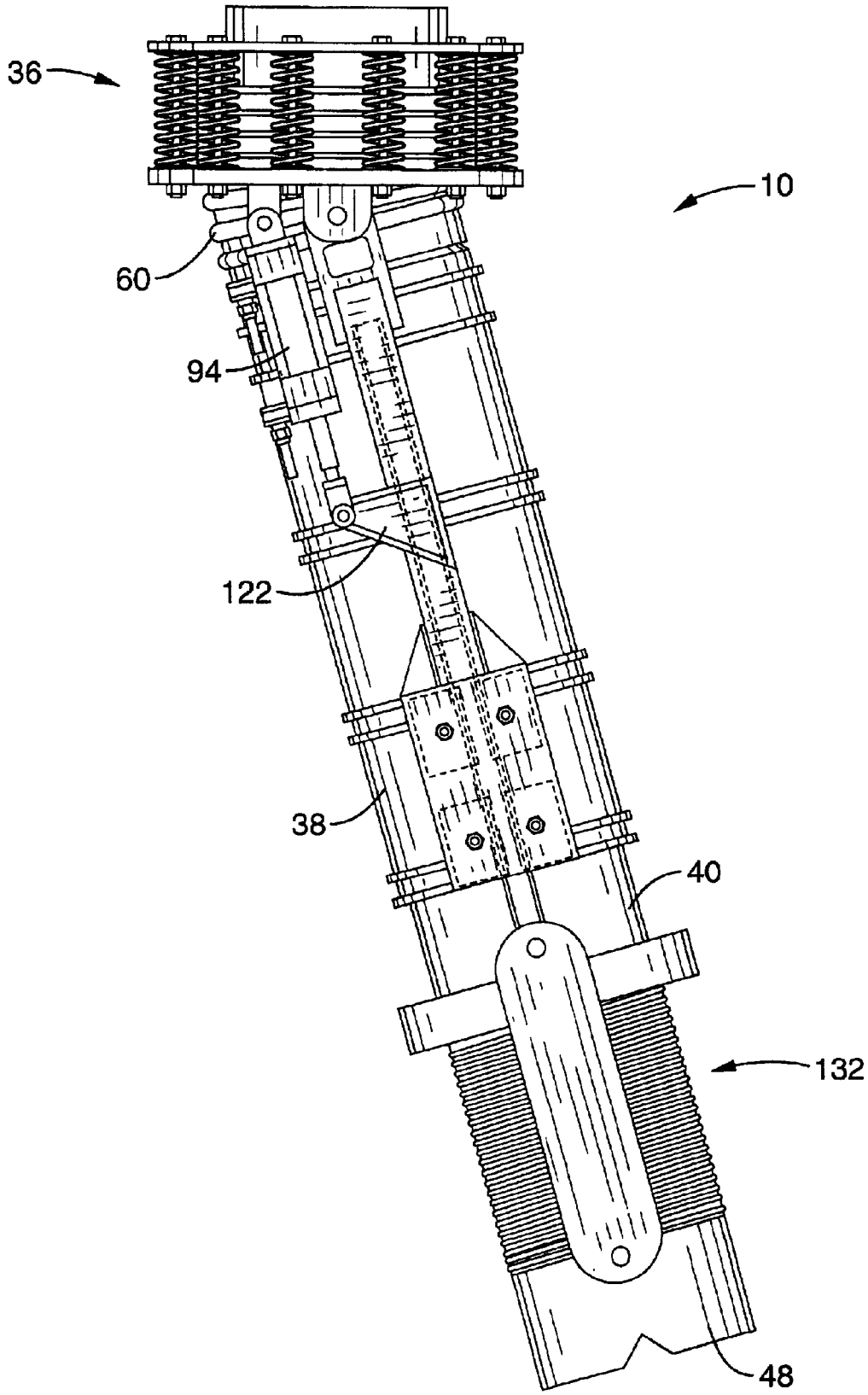
FIG. 13 is a right side view of the nozzle assembly shown in FIG. 2 according to the present invention with the short cylinder in the extended position and the long stroke cylinders at unequal lengths.

Referring now to FIG. 10, FIG. 11 and FIG. 13, the movement of the nozzle assembly 10 from the actuation of the short cylinder 94 is shown. It can be seen that the actuation of the short cylinder 96 causes movement of the base 38 and fly 40 with respect to the upper joint 36 from the vertical position shown in FIG. 10 to a position shown in FIG. 11 or in FIG. 13.

Requiring the vehicle operator to continuously steer back and forth across the shoulder of the roadway would be hazardous to the operator as well as to passing motorists. In order to access a wide path of roadway without requiring large steering adjustments, the actuation of the short cylinder 94 creates a side-to-side sweeping motion as the base 38 pivots about pins 96*a*, 96*b* that couple base 38 to the bottom tray 54 of the upper joint 36. In this fashion, the nozzle assembly 10 can sweep over a large path of roadway with or without the aid of the overhead boom movements. The bottom center of the nozzle tip 48 can preferably function above ground level as well as below ground level.

The actuation of the short stroke cylinder 94 alone will pivot the base 38 with respect to the upper joint 36 while the nozzle bracket assembly 132 remains in the resting position as seen in FIG. 11. When the short stroke cylinder 94 is extend and retracted, the nozzle bracket assembly 132 and the base 38 articulate in opposite directions. Since the nozzle assembly 132 can pivot around pins 136 and 150, the nozzle tip 48 can remain generally perpendicular to the ground during the sweeping motion created by the actuation of the short stroke cylinder 94 and the long stroke cylinders 42*a*, 42*b* remain at rest and at equal lengths.

It can be seen that the orientation of the boom attachment joint 36 is parallel to the orientation of the length of the nozzle assembly 132. The long stroke cylinders 42*a*, 42*b* can maintain this orientation without continuous adjustments during the sweep cycle because of the four-bar linkage configuration.

Figure 12:
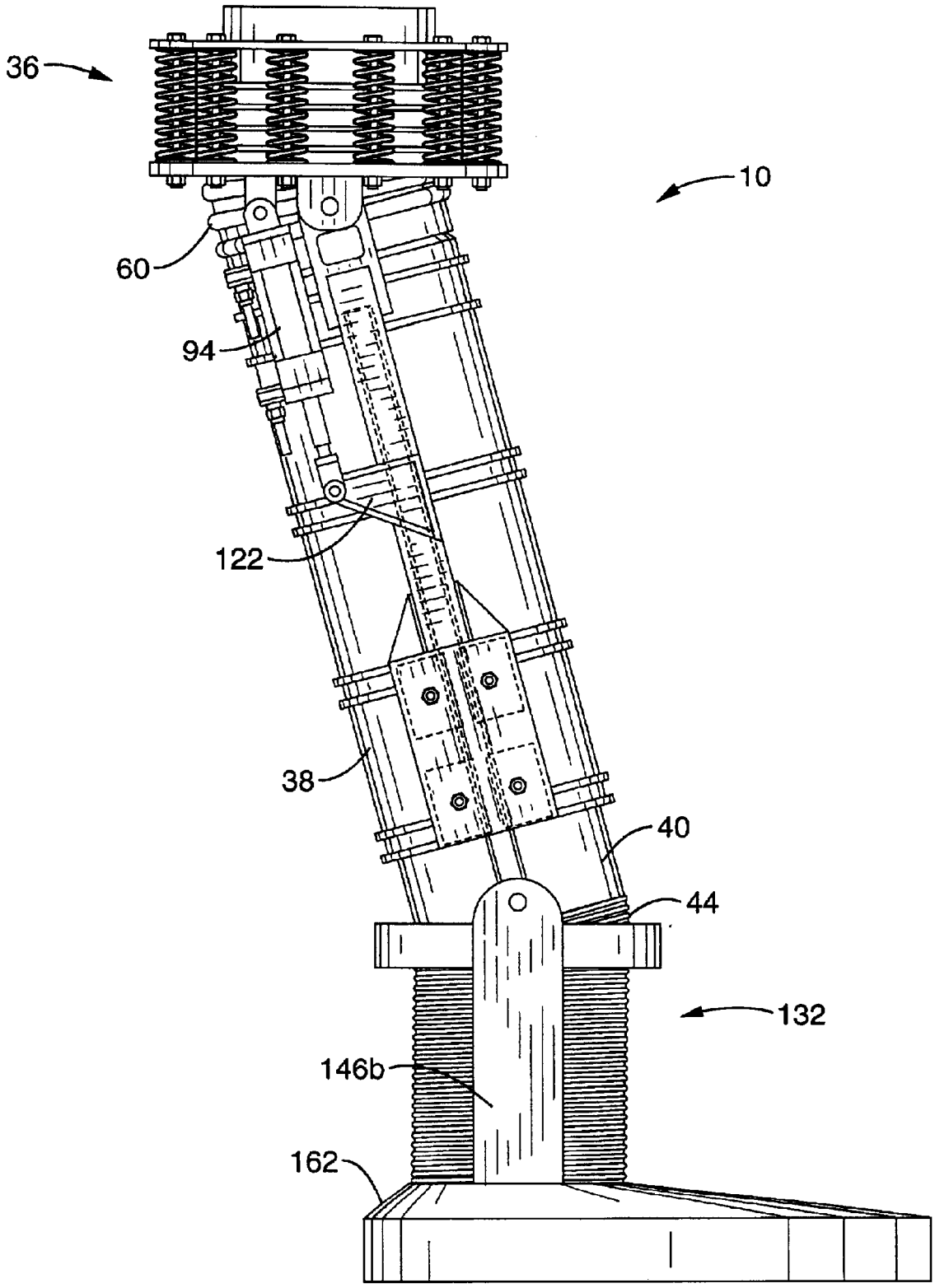
FIG. 12 is a right side view of an alternative embodiment of the present invention showing an off centered fixed nozzle tip.

Turning now to FIG. 12, an alternative embodiment of the invention is shown that has a fixed nozzle tip 162 that is mounted to nozzle bracket arms 146*a*, 146*b*. In the embodiment shown, the nozzle tip 162 is wide and non-symmetric. The orientation of the nozzle tip 162 can only be manipulated by the actuation of the long stroke cylinders 42*a*, 42*b* which cause the nozzle bracket assembly 132 to pivot about pins 136 and 150.

When the lateral sweeping motion caused by short stroke cylinder 94 moves the base 38 back and forth, the parallel bar linkage configuration causes nozzle assembly 132 to maintain its orientation with respect to the road. This feature avoids the need for constant adjustments of long stroke cylinders 42*a*, 42*b* to maintain the orientation of nozzle tip 162. The off centered nozzle tip 162 of FIG. 12 is configured to reach under guardrails and bushes and the like.

Turning now to FIG. 13, the simultaneous actuation of the short stroke cylinder 94 and the unequal actuation of the long stroke cylinders 42*a*, 42*b* is shown. As also seen in FIG. 9, the unequal actuation of the long stroke cylinders 42*a*, 42*b* allows the articulation of the nozzle bracket assembly 132 with respect to the base 38 and fly 40. In the embodiment shown in FIG. 13, the nozzle bracket assembly is configured to engage a sloped surface or a gutter where the surface to be cleaned is not horizontal. Additionally, the ground surface will passively orient the nozzle tip 48 during the sweep along the sloped surface.

In the alternative embodiment shown in FIG. 14, the fly is replaced with flexible tubing. In this embodiment, the flexible tube 44 from the nozzle tip 48 is extended and fixed directly to the bottom of the tubular base 38 and the need for sealing the sliding components of a fly is avoided. Extension of long stroke cylinders 42*a*, 42*b* extends the nozzle bracket assembly as well as the compressible flexible hose 44.

It is preferred that the cross-section of the roller tracks 116 be increased to support the bending load that is carried by the fly in the preferred configuration. Accordingly, the longitudinal channels 108*a* and 108*b* would be correspondingly widened to accommodate the wider roller tracks 116 and closed off from the internal volume of the base 32. In addition, it is preferred that the flexible tube 44 be very compressible to allow for the vertical motion of the nozzle assembly 132.

Figure 15:
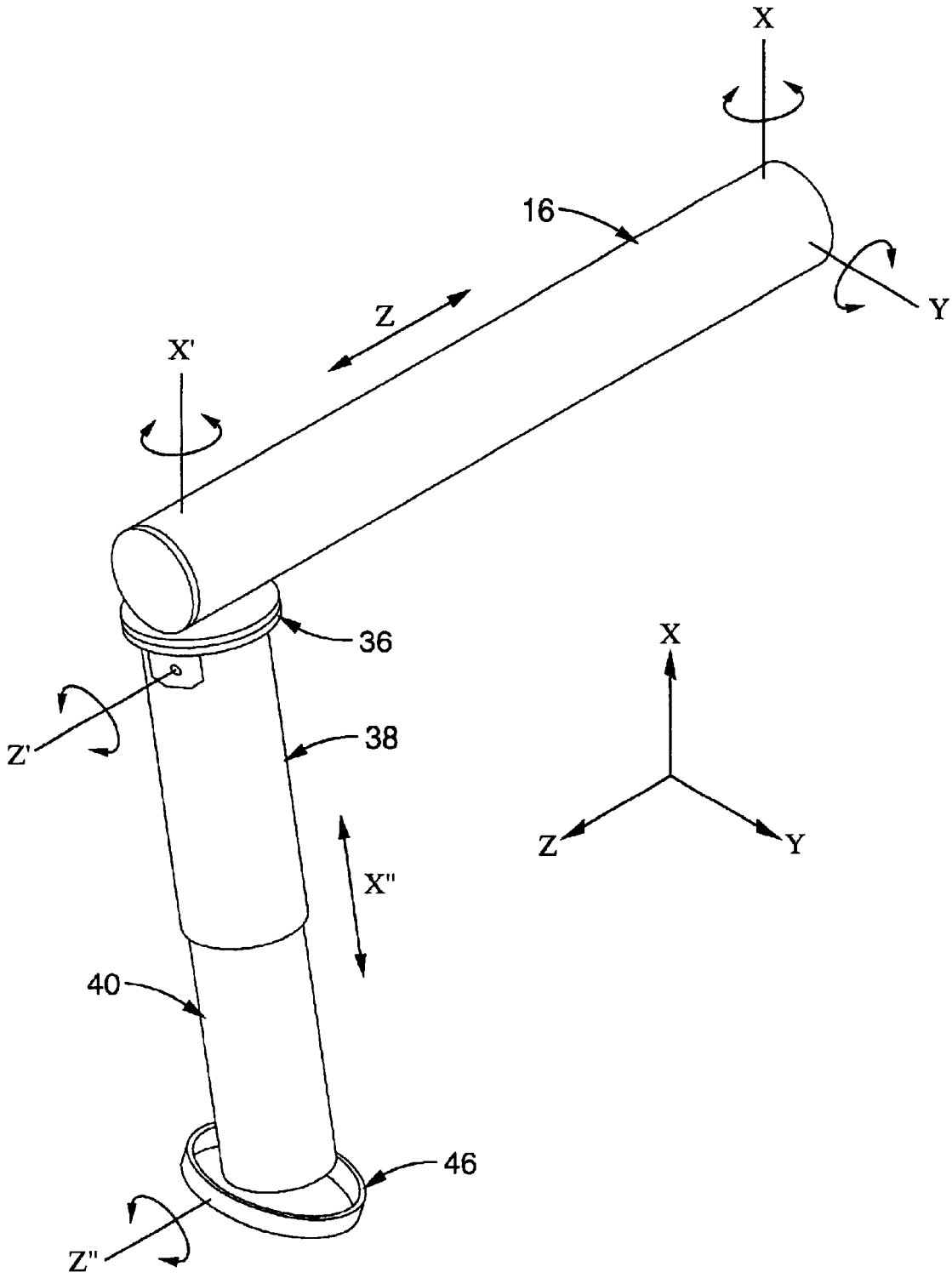
FIG. 15 is a schematic diagram of the preferred axes of rotation and lines of extension of the boom and nozzle assembly of the present invention as shown in FIG. 1.

The preferred movements of the boom 16 and nozzle assembly 10 are shown schematically in FIG. 15. Control over the movements of the boom 16 and nozzle assembly 10 as well as control over auxiliary engine 30 startup, shutdown, engine throttle, electrical systems and hydraulic systems are preferably accessible to the operator in the cab 14.

The hydraulic valves for both of the long stroke cylinders 42*a*, 42*b* preferably have proportional controllers (not shown) but may also be of the on-off variety. The controllers may be stacked atop flow controlling valves that permit fine-tuning of the hydraulic oil flow rates into both sides of the cylinders.

The hydraulic valve stack for the short stroke cylinder 94 is also preferably proportional so as to selectively control the sweeping speed of the nozzle assembly 10. In one embodiment, an adjustable pressure bypass valve in the valve stack allows the short cylinder 94 to move when a threshold load limit is surpassed. This aids in preventing system damage in the event that the nozzle assembly 10 strikes a fixed object.

In the preferred embodiment, a three-axis joystick equipped with a plurality of momentary switches controls all motion of the boom 16 and nozzle assembly 10. In one embodiment, the X-axis of the joystick (left-right motion) operates the short stroke cylinder and sweeps the nozzle assembly 10 back and forth. The further the joystick is perturbed from its center, the faster the arm will swing to the same side. The Y-axis of the joystick (top-bottom motion) extends and retracts the length of the boom 16. The Z-axis of the joystick, i.e. rotation of the handle, preferably rotates boom 16 clockwise or counter-clockwise. It is preferred that the control of all motions of the nozzle assembly and the fully mobile overhead boom 16, be integrated into the same multi-function joystick through the use of a programmable micro controller (not shown) known in the art.

In one embodiment, four switches or thumb-actuated buttons operate the long stroke cylinders 42*a*, 42*b*. The actuation of each switch causes (1) extension of fly 40, (2) retraction of fly 40, (3) nozzle bracket assembly 132 clockwise rotation, and (4) nozzle bracket assembly 132 counterclockwise rotation.

Figure 16:
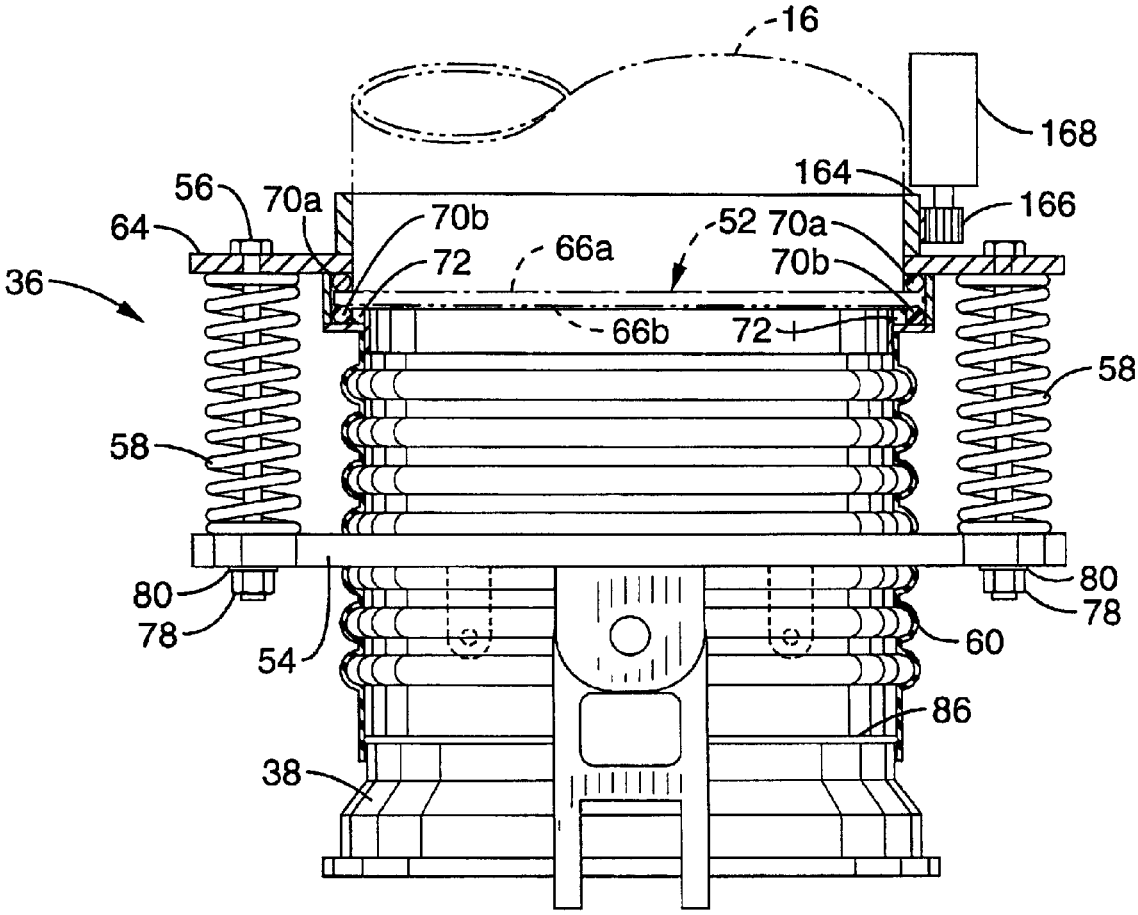
FIG. 16 is a side sectional view of a motor and gear configuration of the present invention allowing the axial rotation of the nozzle assembly shown in FIG. 2.

In this embodiment, the means for allowing the axial rotation of the nozzle assembly 10 with respect to the boom 16, identified as the X' axis in FIG. 15, is an electric motor. As seen in FIG. 16, the lip 68 of the upper tray 50*a*, 50*b* has a set of teeth 164 that mesh with the teeth of gear 166. Gear 166 is preferably rotated by a reversible electric motor 168. It can be seen that the clockwise or counter-clockwise rotation of the motor 168 and gear 166 will cause the upper joint 36 to rotate axially along the sets of ball bearings 70*a* and 70*b* thereby selectively controlling the orientation of the assembly 10. Although an electric motor and gearing is preferred, it will be understood that a pneumatic, hydraulic or other motor known in the art can be used.

In use, a vehicle 12 equipped with the invention can be easily driven to the desired location for highway cleaning. Roadway refuse on the non-traffic side of the guardrail, for example, can be removed by the operator through the general placement of the nozzle assembly 10 over the guardrail by lifting and extending boom 16 and then orienting the nozzle assembly 10. Extensible motion of the fly 40 is controlled by the twin long-stroke cylinders 42*a*, 42*b* that interface with the bottom of the fly 40 at the lift pin sleeve 128*a* and the cylinder flange 130. Orientation of the nozzle tip intake 20 over the refuse occurs by actuation of the long stroke cylinders 42*a*, 42*b*. Running both long cylinders up simultaneously retracts the fly 40. Running both long stroke cylinders 42*a*, 42*b* down extends the fly 40. If the left cylinder 42*a* is drawn up while the right cylinder 42*b* proceeds downward, the nozzle bracket assembly 132 will rotate clockwise. The opposite is true for counterclockwise nozzle bracket 132 rotation.

Additionally, roadside sweeping can be conducted by the regular actuation of the short stroke cylinder 94 swinging the nozzle assembly 10 in a predictable pattern. Actuation of the short stroke cylinder can be automated or performed by hand.

Accordingly, it will be seen that this invention is a particulate vacuum system with a dexterous nozzle assembly to facilitate the placement of an intake nozzle tip by the operator while remaining in the cab of the vehicle. While the invention is described within the context of a vacuum vehicle, it will be apparent that the invention can be easily adapted to any system that requires placement of an intake or output member.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A nozzle apparatus for vacuum removal of debris, comprising:

a tubular base member capable of being attached to a conduit;

an extensible member slidably coupled to said base member;

said extensible member configured for longitudinal extension and retraction;

said extensible member having a nozzle tip;

means for extending or retracting said extensible member; and a coupling member;

said coupling member configured for coupling said tubular base member to a conduit.

2. An apparatus as recited in claim 1, wherein said base member is pivotally coupled to said coupling member.

3. An apparatus as recited in claim 2, further comprising means for pivoting said base member in relation to said coupling member.

4. An apparatus as recited in claim 3, wherein said means for pivoting said base member comprises a controllable actuator having a first end coupled to said base member and a second end coupled to said coupling member.

5. An apparatus as recited in claim 1, wherein said coupling member is configured to dampen and reduce the force of impact of the apparatus with a surface during use.

6. An apparatus as recited in claim 1, wherein said coupling member comprises a universal joint configured for coupling said base member to a conduit.

7. An apparatus as recited in claim 6, wherein said universal joint comprises:

an upper tray configured for coupling to said conduit; and a lower tray coupled to said nozzle assembly;

said lower tray coupled to said upper tray with a plurality of resilient members;

wherein the joint between said base and a conduit is compliant.

8. An apparatus as recited in claim 6, wherein said universal joint is configured to rotate axially.

9. A nozzle apparatus for vacuum removal of debris, comprising:

a tubular base member capable of being attached to a conduit;

an extensible member slidably coupled to said base member;

said extensible member configured for longitudinal extension and retraction;

said extensible member having a nozzle tip;

means for extending or retracting said extensible member; and a nozzle tip coupled to said extensible member.

10. An apparatus as recited in claim 9, wherein said nozzle tip is pivotally coupled to said extensible member.

11. An apparatus as recited in claim 9, wherein said nozzle tip further comprises:

a flexible tube coupled to said extensible member and having an open end; and means for changing the direction of said open end of said flexible tube.

12. An apparatus as recited in claim 11, wherein said means for changing the direction of the end of said nozzle comprises:

a nozzle bracket pivotally mounted to said extensible member;

said bracket coupled to said flexible tube and mounted to a distal end of said extensible member;

said flexible tube having a nozzle mouth; and at least one pair of long stroke controllable actuators mounted to said nozzle bracket;

wherein differential actuation of said actuators changes the direction of nozzle bracket and said end of said flexible tube.

13. An apparatus as recited in claim 12, wherein said nozzle mouth is pivotally coupled to said nozzle bracket.

14. A nozzle apparatus for vacuum removal of debris, comprising:

a tubular base member capable of being attached to a conduit;

an extensible member slidably coupled to said base member;

said extensible member configured for longitudinal extension and retraction;

said extensible member having a nozzle tip;

a controllable actuator configured for extending or retracting said extensible member; and a coupling member;

said coupling member configured for coupling said tubular base member to a conduit.

15. An apparatus as recited in claim 14, wherein said base member is pivotally coupled to said coupling member.

16. An apparatus as recited in claim 15, further comprising means for pivoting said base member in relation to said coupling member.

17. An apparatus as recited in claim 16, wherein said means for pivoting said base member comprises a controllable actuator having a first end coupled to said base member and a second end coupled to said coupling member.

18. An apparatus as recited in claim 14, wherein said coupling member is configured to dampen and reduce the force of impact of the apparatus with a surface during use.

19. An apparatus as recited in claim 14, wherein said coupling member comprises a universal joint configured for coupling said base member to a conduit.

20. An apparatus as recited in claim 19, wherein said universal joint comprises:

an upper tray configured for coupling to said conduit; and a lower tray coupled to said nozzle assembly;

said lower tray coupled to said upper tray with a plurality of resilient members;

wherein the joint between said base and a conduit is compliant.

21. An apparatus as recited in claim 19, wherein said universal joint is configured to rotate axially.

22. A nozzle apparatus for vacuum removal of debris comprising:

a tubular base member capable of being attached to a conduit;

an extensible member slidably coupled to said base member;

said extensible member configured for longitudinal extension and retraction;

said extensible member having a nozzle tip;

a controllable actuator configured for extending or retracting said extensible member; and a nozzle tip coupled to said extensible member.

23. An apparatus as recited in claim 22, wherein said nozzle tip is pivotally coupled to said extensible member.

24. An apparatus as recited in claim 22, wherein said nozzle tip further comprises:

a flexible tube coupled to said extensible member and having an open end; and means for changing the direction of said open end of said flexible tube.

25. An apparatus as recited in claim 24, wherein said means for changing the direction of the end of said nozzle comprises:

a nozzle bracket pivotally mounted to said extensible member;

said bracket coupled to said flexible tube and mounted to a distal end of said extensible member;

said flexible tube having a nozzle mouth; and at least one pair of long stroke controllable actuators mounted to said nozzle bracket;

wherein differential actuation of said actuators changes the direction of nozzle bracket and said end of said flexible tube.

26. An apparatus as recited in claim 25, wherein said nozzle mouth is pivotally coupled to said nozzle bracket.

27. A particulate matter moving apparatus, comprising a dexterous extensible nozzle assembly configured to be pivotally coupled to a conduit; and means for manipulating the position of the nozzle assembly;

wherein the elevation and location of said nozzle assembly can be precisely adjusted; and wherein said dexterous nozzle assembly further comprises a universal joint capable of coupling said nozzle assembly to a conduit.

28. An apparatus as recited in claim 27, wherein said universal joint comprises:

an upper tray configured for mounting to a conduit;

said upper tray having an annular channel;

a lower tray mounted to said nozzle assembly;

said lower tray coupled to said upper tray; and a plurality of flexible bearings evenly disposed within said annular channel of said upper tray;

wherein said nozzle assembly can rotate axially.

29. A particulate matter moving apparatus, comprising:

a dexterous extensible nozzle assembly configured to be pivotally coupled to a conduit; and means for manipulating the position of the nozzle assembly;

wherein the elevation and location of said nozzle assembly can be precisely adjusted;

wherein said extensible nozzle assembly comprises:

a cylindrical base;

a fly slidably coupled to said base; and a nozzle tip coupled to said fly.

30. An apparatus as recited in claim 29, wherein said nozzle tip further comprises:

a flexible tube coupled to said fly and having an open end; and means for changing the direction of said open end of said flexible tube.

31. An apparatus as recited in claim 29, wherein said nozzle assembly further comprises a bracket pivotally connected to said fly and said nozzle tip.

32. An apparatus as recited in claim 29, wherein said means for manipulating the position of the nozzle assembly comprises:

means for pivotally rotating said nozzle assembly with respect to said conduit;

means for extending and retracting said fly longitudinally from said base; and means for changing the direction of said nozzle tip.

33. An apparatus as recited in claim 32, wherein said means for pivoting said nozzle assembly comprises a controllable actuator and flange.

34. An apparatus as recited in claim 32, wherein said means for extending and retracting said fly longitudinally from said base comprises:

at least one pair of long stroke cylinders having first and second ends;

said first ends mounted to said base and said second ends mounted to said fly.

35. An apparatus as recited in claim 32, wherein said means for changing the direction of the nozzle tip comprises:

a nozzle bracket pivotally mounted to said fly;

said bracket coupled to a flexible tube mounted to a distal end of said fly;

said flexible tube having a nozzle mouth; and at least one pair of long stroke cylinders having first and second ends;

said first ends mounted to said base and said second ends mounted to said nozzle bracket.

36. An apparatus as recited in claim 29, wherein said means for changing the direction of the nozzle tip comprises:

a nozzle bracket pivotally mounted to said fly;

said bracket coupled to a flexible tube mounted to a distal end of said fly;

said flexible tube having a nozzle mouth; and at least one pair of long stroke cylinders having first and second ends;

said first ends mounted to a universal joint and said second ends mounted to said nozzle bracket.

37. An apparatus as recited in claim 27 or 29 wherein said means for manipulating the position of the nozzle assembly comprises a controllable actuator.

38. A particulate matter moving apparatus, comprising:

a dexterous extensible nozzle assembly configured to be pivotally coupled to a conduit: and a controllable actuator configured for manipulating the position of the nozzle assembly;

wherein the elevation and location of said nozzle assembly can be precisely adjusted: and wherein said dexterous nozzle assembly further comprises a universal joint capable of coupling said nozzle assembly to a conduit.

39. An apparatus as recited in claim 38, wherein said universal joint comprises:

an upper tray configured for mounting to a conduit;

said upper tray having an annular channel;

a lower tray mounted to said nozzle assembly;

said lower tray coupled to said upper tray; and a plurality of flexible bearings evenly disposed with in said annular channel of said upper tray;

wherein said nozzle assembly can rotate axially.

40. An apparatus as recited in claim 39, wherein said extensible nozzle assembly further comprises:

means for causing the axial rotation of said nozzle assembly.

41. An apparatus as recited in claim 40, wherein said means for causing axial rotation of said nozzle assembly comprises:

a set of teeth extending radially from said upper tray; and a motor with a sprocket configured to engage said teeth;

wherein actuation of the motor caused the axial rotation of said nozzle assembly.

42. A particulate matter moving apparatus, comprising:

a dexterous extensible nozzle assembly configured to be pivotally coupled to a conduit; and a controllable actuator configured for manipulating the position of the nozzle assembly;

wherein the elevation and location of said nozzle assembly can be precisely adjusted; and wherein said extensible nozzle assembly comprises:

a cylindrical base;

a fly slidably coupled to said base;

a nozzle tip coupled to said fly; and means for manipulating the position of the nozzle assembly.

43. An apparatus as recited in claim 42, wherein said nozzle tip further comprises:

a flexible tube coupled to said fly and having an open end; and means for changing the direction of said open end of said flexible tube.

44. An apparatus as recited in claim 43, wherein said means for changing the direction of the nozzle tip comprises:

a nozzle bracket pivotally mounted to said fly;

said bracket coupled to a flexible tube mounted to a distal end of said fly;

said flexible tube having a nozzle mouth; and at least one pair of long stroke cylinders having first and second ends;

said first ends mounted to said base and said second ends mounted to said nozzle bracket.

45. An apparatus as recited in claim 42, wherein said nozzle assembly further comprises a bracket pivotally connected to said fly and said nozzle tip.

46. An apparatus as recited in claim 42, wherein said means for manipulating the position of the nozzle assembly comprises:

means for pivotally rotating said nozzle assembly with respect to said conduit means for extending and rending said fly longitudinally from said base; and means for changing the direction of said nozzle tip.

47. An apparatus as recited in claim 46, wherein said means for manipulating the position of the nozzle assembly further comprises:

means for causing the axial rotation of said nozzle assembly.

48. An apparatus as recited in claim 46, wherein said means for pivoting said nozzle assembly comprises a controllable actuator and flange.

49. An apparatus as recited in 46, wherein said means for extending and retracting said fly longitudinally from said base comprises:

at least one pair of long stroke cylinders having first and second ends;

said first ends mounted to said base and said second ends mounted to said fly.

50. An apparatus as recited in claim 46, wherein said means for changing the direction of the nozzle tip comprises:

a nozzle bracket pivotally mounted to said fly;

said bracket coupled to a flexible tube mounted to a distal end of said fly;

said flexible tube having a nozzle mouth; and at least one pair of long stroke cylinders having first and second ends;

said first ends mounted to a universal joint and said second ends mounted to said nozzle bracket.

51. A nozzle assembly, comprising:

an outer cylinder;

said outer cylinder having a universal joint capable of coupling said outer cylinder with a conduit;

wherein said universal joint is configured to dampen and reduce shear forces;

an inner cylinder disposed within the outer cylinder on a plurality of support rails;

means for extending and retracting said inner cylinder with respect to said outer cylinder; and a dexterous nozzle tip coupled to said inner cylinder.

52. A nozzle assembly as recited in claim 51, wherein said universal joint further comprises:

an upper tray configured for mounting to a conduit; and a lower tray mounted to said upper tray with a plurality of spring tensioned fasteners disposed radially around the periphery of said upper tray and said lower tray;

said lower tray pivotally coupled to said outer cylinder.

53. A nozzle assembly as recited in claim 51, wherein said means for extending and retracting said inner cylinder from said outer cylinder comprises:

at least one pair of long stroke cylinders having first and second ends;

said first ends mounted to said outer cylinder and said second ends mounted to said inner cylinder.

54. A nozzle assembly as recited in claim 51, wherein said dexterous nozzle tip comprises:

a nozzle bracket pivotally mounted to said fly;

said bracket coupled to a flexible tube mounted to a distal end of said inner cylinder;

said flexible tube having a nozzle mouth; and at least one pair of long stroke cylinders mounted to said nozzle bracket;

wherein differential actuation of said long stroke cylinders pivots said nozzle bracket.

55. A nozzle assembly as recited in claim 51, wherein said means for extending and retracting said inner cylinder with respect to said outer cylinder comprises a controllable actuator.

56. A nozzle assembly, comprising:

an outer cylinder;

said outer cylinder having a universal joint capable of coupling said outer cylinder with a conduit;

wherein said universal joint is configured to dampen and reduce shear forces;

an inner cylinder disposed within the outer cylinder on a plurality of support rails;

a controllable actuator configured for extending and retracting said inner cylinder with respect to said outer cylinder; and a dexterous nozzle tip coupled to said inner cylinder.

57. A nozzle assembly as recited in claim 56, wherein said universal joint further comprises:

an upper tray configured for mounting to a conduit; and a lower tray mounted to said upper tray with a plurality of spring tensioned fasteners disposed radially around the periphery of said upper tray and said lower tray;

said lower tray pivotally coupled to said outer cylinder.

58. A nozzle assembly as recited in claim 57, wherein said universal joint further comprises:

a plurality of flexible bearings evenly disposed within a annular channel of said upper tray;

wherein said nozzle assembly can rotate axially.

59. An apparatus as recited in claim 58, wherein said nozzle assembly further comprises:

means for causing the axial rotation of said nozzle assembly.

60. An apparatus as recited in claim 59, wherein said means for causing axial rotation of said nozzle assembly comprises:

a set of teeth extending radially from said upper tray; and a motor with a sprocket configured to engage said teeth;

wherein actuation of the motor caused the axial rotation of said nozzle assembly.

61. A nozzle assembly as recited in claim 56, wherein said controllable actuator for extending and retracting said inner cylinder from said outer cylinder comprises:

at least one pair of long stroke cylinders having first and second ends;

said first ends mounted to said outer cylinder and said second ends mounted to said inner cylinder.

62. A nozzle assembly as recited in claim 56, wherein said dexterous nozzle tip comprises:

a nozzle bracket pivotally mounted to said fly;

said bracket coupled to a flexible tube mounted to a distal end of said inner cylinder;

said flexible tube having a nozzle mouth; and at least one pair of long stroke cylinders mounted to said nozzle bracket;

wherein differential actuation of said long stroke cylinders pivots said nozzle bracket.

63. A vacuum nozzle assembly, comprising:

a cylindrical base;

a universal joint configured for coupling said cylindrical base to an intake conduit;

said universal joint having an upper tray configured for mounting to said intake conduit;

said upper tray having an annular channel;

said upper tray having a plurality of teeth;

a motor having a gear operably engaging said teeth of said upper tray;

a lower tray mounted to said cylindrical base;

a plurality of flexible bearings evenly disposed within said annular channel of said upper tray;

a plurality of spring tensioned fasteners disposed radially around the periphery of said upper tray tube and said lower tray;

a fly slidably coupled to said cylindrical base;

said fly disposed within the cylindrical base on a plurality of support rails;

a nozzle bracket pivotally mounted to said fly;

said bracket coupled to a flexible tube mounted to a distal end of said inner cylinder;

said flexible tube having a nozzle mouth; and at least one pair of long stroke cylinders having first and second ends;

said first ends mounted to said cylindrical base and said second ends mounted to said nozzle bracket;

said long stroke cylinders configured for actuation by a user.

* * * * *